US007491109B2

(12) United States Patent
Rouse

(10) Patent No.: US 7,491,109 B2
(45) Date of Patent: Feb. 17, 2009

(54) CONTINUOUS BALLOON STRUCTURES—2

(76) Inventor: Graham Manly Rouse, 430 Queen St., Columbia, SC (US) 29205

( * ) Notice: Subject to any disclaimer, the term of this patent is extended or adjusted under 35 U.S.C. 154(b) by 349 days.

(21) Appl. No.: 11/475,614

(22) Filed: Jun. 27, 2006

(65) Prior Publication Data

US 2006/0240740 A1 Oct. 26, 2006

Related U.S. Application Data

(63) Continuation-in-part of application No. 10/326,888, filed on Dec. 19, 2002, now Pat. No. 7,094,124, and a continuation-in-part of application No. 10/002,963, filed on Dec. 5, 2001, now abandoned, and a continuation-in-part of application No. 09/542,674, filed on Apr. 1, 2000, said application No. 10/002,963 is a continuation-in-part of application No. 09/066,119, filed on Apr. 24, 1998, now Pat. No. 6,332,823.

(60) Provisional application No. 60/341,928, filed on Dec. 19, 2001, provisional application No. 60/008,096, filed on Oct. 30, 1995.

(51) Int. Cl.
*A63H 27/10* (2006.01)

(52) U.S. Cl. ..... 446/220

(58) Field of Classification Search ..... 446/220, 446/221, 222, 223, 224, 225, 226
See application file for complete search history.

(56) References Cited

U.S. PATENT DOCUMENTS

| | | | | | |
|---|---|---|---|---|---|
| 2,470,990 | A | * | 5/1949 | Kennedy | 156/145 |
| 3,626,634 | A | * | 12/1971 | Jones et al. | 446/122 |
| 3,676,276 | A | * | 7/1972 | Hirsen et al. | 428/12 |
| 4,693,695 | A | * | 9/1987 | Cheng | 446/220 |
| 4,892,500 | A | * | 1/1990 | Lau | 446/221 |
| 5,183,432 | A | * | 2/1993 | Noguchi | 446/220 |
| 5,769,685 | A | * | 6/1998 | Nakamura et al. | 446/221 |

* cited by examiner

*Primary Examiner*—John Ricci

(57) ABSTRACT

A structural, informative and/or decorative balloon display is comprised of a plurality of connected, inflatable chambers formed by a plurality of die applications to a plurality of layers of film. The largest die application produces a set of seals that encompasses an area smaller than the area encompassed by all such sets of seals. In one preferred embodiment connected chambers have and maintain fluid communication. In another preferred embodiment, connected, inflatable chambers have no fluid communication but have a beginning and an end. In other preferred embodiments fluid communication is terminated after inflation. Other embodiments take advantage of variations of numbers of layers, configurations of layers, and treatment of surfaces to create special balloon forms.

18 Claims, 15 Drawing Sheets

FIG. 7
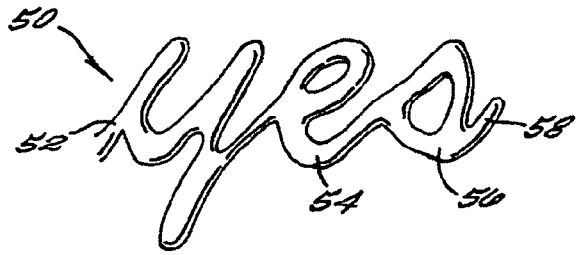
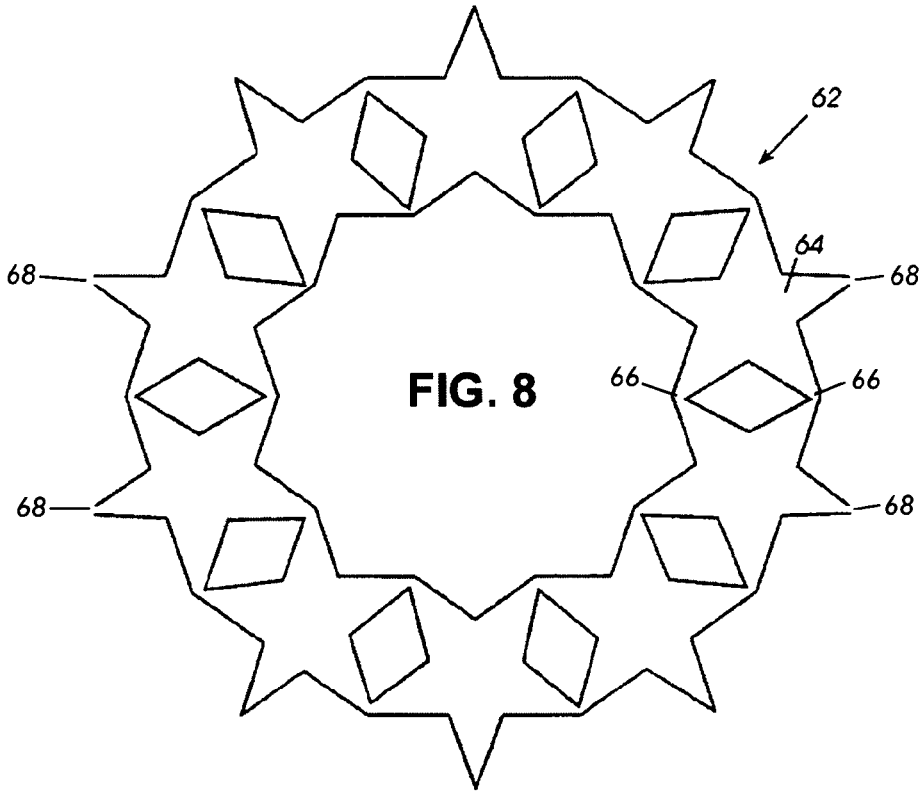
FIG. 8
FIG. 9
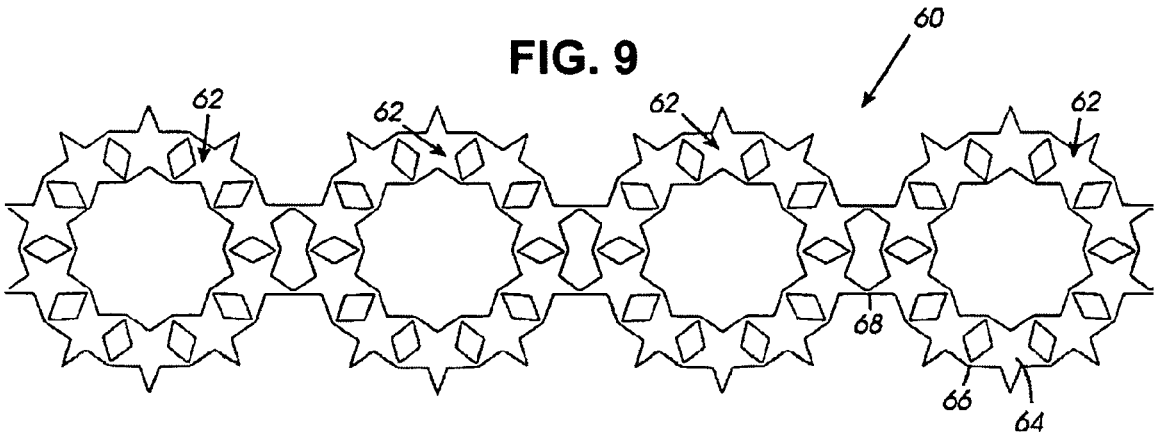

CONTINUOUS BALLOON STRUCTURES—2

CROSS REFERENCE TO RELATED APPLICATIONS

The present application claims the benefit of U.S. Provisional Application Ser. No. 60/008,096, filed Oct. 30, 1995. The current application also claims benefit and priority date of provisional application No. 60/341,928 titled "Balloon Display Systems" (BDS) filed Dec. 19, 2001.

This application is a continuation in part of application Ser. No. 10/326,888 by this inventor titled "Rouse Display Systems" (RDS) filed Dec. 19, 2002 now U.S. Pat. No. 7,094,124. The entire content of application Ser. No. 10/326,888 is hereby included by reference as part of this application.

Application Ser. No. 10/326,888 claimed benefit and priority date of provisional application No. 60/341,928 titled "Balloon Display Systems" (BDS) filed Dec. 19, 2001. The current application also claims benefit and priority date of provisional application No. 60/341,928 titled "Balloon Display Systems" (BDS) filed Dec. 19, 2001.

Application Ser. No. 10/326,888 is, in turn, a continuation in part of two applications by this inventor. They are application Ser. No. 10/002,963 titled "Continuous Balloon Structures" (CBS) filed Dec. 5, 2001 now abandoned and application Ser. No. 09/542,674 titled "Advanced Aperture Framework Balloon Display" (AAD) filed Apr. 1, 2000. The entire content of application Ser. No. 10/002,963 and application Ser. No. 09/542,674 are hereby included by reference as part of this application.

The CBS application is a continuation in part application of application Ser. No. 09/066,119 titled "Balloon Displays" (BD) filed in the United States Apr. 24, 1998 and issued Dec. 25, 2001 as U.S. Pat. No. 6,332,823. The entire content of application Ser. No. 09/066,119 is hereby included by reference as part of this application.

The BD application claimed the benefit and priority date of U.S. Provisional Application Ser. No. 60/008,096, filed Oct. 30, 1995. The current application claims the benefit and priority date of U.S. Provisional Application Ser. No. 60/008,096, filed Oct. 30, 1995.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present invention is related generally to balloons for use as decoration, information and decorative architecture.

(2) Discussion of Background

The background of the invention is discussed at some length in related, earlier applications. Those discussions are incorporated herein by references specified above. The following discussion focuses background information toward the specific claims of this continuation in part application.

Balloons have been used as decorations for decades, but they have enjoyed increased usage in the recent past. There are two type of balloons commonly used for decor plus a variety of patented, specialty balloons. Balloons have traditionally been made of natural latex. Molds are dipped into a vat of liquid latex. Some of the latex adheres to the mold. The mold is removed and the adhered latex dries into a highly elastic membrane. The membrane is removed from the mold for use. The balloon thus created is usually a bulbous form with a single, narrow, tubular stem, and opening for inflation. Once inflated, latex balloons are most commonly sealed by tying a knot in the inflation stem of the balloon. Less common are the use of mechanical fasteners and internally installed, self-sealing valves to seal latex balloons.

There are a large variety of techniques and systems used in the trade to connect latex balloons directly to each other to some common material or object to serve structural and decorative functions. There are, however, relatively few systems especially designed and manufactured for these purposes.

The second type of balloon commonly used for decor is made by heat sealing two layers of thin, light weight, air-tight film together along lines which define the outer edges of the balloon shape. The balloon thus created is usually a bulbous form with a single, narrow, tubular stem, and opening for inflation. Once inflated, film balloons are most commonly closed by heat sealing the open stem. Self-sealing valves in the stems of the film balloons is rising in importance as the sealing method of choice. Tying knots in the stem of the film balloons is becoming less common and mechanical fasteners are also less common with film balloons.

The variety of techniques and systems used in the trade to connect film balloons parallels that of latex balloons. One exception, however, is the use of paper clips or other wire hooks poked through the uninflated stem of the latex balloon, because films commonly used for balloons, although quite strong, tear easily once penetrated. A second exception is pinching and twisting a film balloon across an inflated chamber, because the relatively inelastic nature of films often makes such a procedure impractical.

Under current standard manufacturing methods for film balloons, a single die may produce multiple identical balloons either by repeated application or by one application of a complex die, however, the balloons thus created are not in fluid communication. Also under current methods, a single die impression may produce multiple chambers in fluid communication, but the chambers are not identical and balloons created are not connected at manufacture to other balloons. Finally, multiple dies may be used on a common sheet of film, but the balloons thus created are not in fluid communication with each other.

Under current methods each die impression normally produces an independent balloon which looks and functions like an independent balloon. (In recent years, however, some larger, single balloons have come on the market. They look like several similar balloons of different sizes in a connected cluster.) Each of the normal balloons must be inflated and sealed independently and individually joined with others into groups or placed as an independent decorative element. Film balloons are more expensive than latex, but they are stronger, last longer and can be reused. In order to save them for reuse, however, each balloon manufactured under current methods must be unsealed, deflated and packed for storage independently.

Balloons with special features or contours are known and have been the subject of U.S. patents. For example, Akman (U.S. Pat. No. 5,282,768) teaches a balloon with a tube passing there though. The tube pierces the wall of the balloon and is sealed to the wall with constriction rings. Hirshen, et al. (U.S. Pat. No. 3,676,276) describe a plurality of inflatable, individual cells that are interconnected. Each cell is independently inflated.

Devices having a plurality of interconnected balloons are also well known. Lau (U.S. Pat. No. 4,892,500) and Gordon (U.S. Pat. No. 2,187,493) both show balloon networks. Lau provides balloons with multiple spouts thus, the balloons can be connected to other balloons or a pole using adapter plugs. Gordon attaches balls to the outer ends of a plurality of arms that extend from a central hub.

Lemelson (U.S. Pat. No. 4,179,832) and Chalfin (U.S. Pat. No. 3,358,398) teach inflatable display devices. In Lemelson's device, a plurality of inflatable, upwardly-extending portions are welded to an inflatable ring. Strings of lamps extend along the inside or outside walls of the display. Chalfin places inflatable letters in a channel so that the letters are held within the channel. Alternatively, the letters are integrally formed with an inflatable base.

Kennedy (U.S. Pat. No. 2,470,990) describes a method for making permanently-sealed inflated toys. Plastic sheet material is printed or silk screened to produce a plurality of outlines extending outwards from a central channel, then heat-sealed to another sheet using a die to form shapes connected to a single manifold. The shapes are inflated then heat-sealed at there connection to the manifold and cut from the manifold.

There remains a need for a way to produce a display of many film balloons and to be able to inflate, install, and later deflate and remove them quickly and easily. Such advances could make professional decorating with film balloons more cost competitive with decorations ordinarily done with latex balloons and with decorations done in other media. Such advances could make amateur decorations easier and quicker so as to appeal at a less skilled mass market.

Under standard methods for making film balloons each die application produces independent balloons which look and function like independent balloons. In the years since this application was originally filed there have arrived on the market, new balloons with connected inflatable chambers that have fluid communication between chambers. These, however, are multi-chambered balloons made with a single die application and they are commonly designed to look and act like a single figure.

This application teaches the formation of continuous balloon structures. Continuous balloon structures are defined as a plurality of continuously connected inflatable chambers joined by the same material from which the chambers are formed when a plurality of die applications are made to a plurality of layers of film.

Currently, preferred films would be nylon, polyester or any of a variety of thin plastic sheets that are strong, flexible and gas impermeable. For purposes of this application, however, we would consider "films" more broadly to include other relatively thin sheets of materials from which inflatable chambers might be made. This could include but not be limited to papers, fabrics, vinyl, latex, synthetic rubber and even metals.

Continuous balloon structures are not limited by the size of a single die nor do they require post manufacture assembly of many individual balloons to get the effect of an assembly of a many individual balloons. In its original form, this application teaches the formation of a plurality of connected inflatable chambers by a plurality of die applications to a plurality of layers of film wherein a plurality of inflatable chambers thus formed have fluid communication. These continuous balloon structures of connected inflatable chambers with fluid communication among chambers are labeled as "balloon systems", That plurality could be as short as two inflatable chambers or a continuous array of thousands. Such a series of inflatable chambers can be inflated at once. This can save significant time in inflating and installing a balloon display and can assure the relative placement of inflated chambers within the display. Such a series of inflatable chambers can also be deflated at once. This can save significant time in deflating and storing the display. Such a continuous balloon structure requires less skill than displays compiled from individual balloons. As such, the new balloon system should have appeal to a broader, mass market.

The biggest disadvantage of such a system of inflatable chambers is the possibility that a leak may occur in one of the series of inflated chambers. A leak in one of the chambers could lead to the premature deflation of all of the chambers in the series.

There has remained the need to gain the benefits of inflating multiple chambers at once while reducing the risk of premature deflation in all chambers when one develops a leak. There also has remained a need to gain the benefits of inflatable chambers being connected at manufacture, while eliminating the risk of all chambers deflating simply because of a leak in one. This continuation in part discloses all the innovations of this application in its original form plus solutions to these remaining needs.

In its original form this application teaches a variety of additional dependent innovations. It teaches the innovation of utilizing more than two layers of film in a continuous balloon structure. It teaches the innovation of utilizing custom treatments and coatings to layers of film in such a continuous balloon structure. It teaches the innovation of utilizing custom configurations of cuts in layers of film that form such a continuous balloon structure. There remains the need to incorporate these dependent innovations into the advances added here.

These and other innovations are disclosed in the following sections.

BRIEF SUMMARY OF THE INVENTION

According to its preferred aspects and briefly stated, the present invention is a continuous balloon structure and a method for creating the continuous balloon structure. This structure would most often be inflated with gas, sealed and used as a balloon display with decorative, informative and/or structural value. It may, however, be used without the chambers being filled or with chambers filled with other fluids. The structure might also be used as a conduit, carrier or wrap for fluids, particles, objects, light, sound, electricity, electronic impulses, etc.

The continuous balloon structure is a plurality of connected inflatable chambers that are formed from a plurality of layers of film by a plurality of die applications. Die applications create sets of seals between layers of film. The area encompassed by all seals is greater than the area encompassed by any single set of seals.

In one group of preferred embodiments, the continuous balloon structure will be constructed as a series of chambers with a beginning and an end where the two ends are not contiguous. In another group of preferred embodiments there will be fluid communication between/among multiple chambers.

In one example the continuous balloon structure is a balloon system that is constructed primarily by the repeated application of the same die, a die that is formed to interconnect the shape so formed such that each inflatable chamber created by the die is automatically in fluid communication with the previous one formed. Additionally, certain features are incorporated into the interconnecting conduits so that the inflatable chambers maintain their alignment when inflated. Also, variations in the primary process are taught herein to allow variations in the chain of inflatable chambers. Because the balloon system is actually all one balloon, although it may appear to be dozens, perhaps thousands, of balloons, it has the advantage of being more easily inflated than individual balloons that would otherwise be needed to create the same display. To minimize the risk of puncture in a continuous balloon structure that is actually one large balloon, high quality, more puncture-resistant balloon films are preferred to latex rubber.

The simplest form of continuous balloon structure is a row of inflatable chambers. However, by the use of more complex dies, as would be best effected with a computer controlled laser sealing process, by use of more than two layers of film, by the use of layers of film in different shapes, and by use of a predetermined pattern of adhesive enhancing and resistant treatments or inserts, extraordinary structures can be created in three dimensions. These structures are single balloons, and when inflated, form passages, inflatable chambers, and openings for other balloons, continuous balloon structures, and possibly other objects. A major advantage of such a multidimensional continuous balloon structure is that complex three dimensional balloon shapes can be made of a single high-quality balloon for repeated use.

Many other features and advantages will be apparent to those of ordinary skill in the art of making and using balloons from a careful reading of the Detailed Description of Preferred Embodiments of the present invention, accompanied by the associated drawings.

This disclosure teaches three basic methods to gain the benefits of continuous balloon structures while reducing the risk that a leak in one chamber will result in deflation of an adjacent chamber.

The first method is to terminate fluid communication between inflatable chambers in a continuous balloon structure after they have been inflated. The connection between inflated chambers might be die sealed, clamped shut or simply be twisted tightly to close off the fluid communication. A die seal might be permanent and therefore loose the benefits of deflating all chambers at once when you desire. Clamps on the other hand might be removed for deflation. Seals made by twisting the balloon might be unsealed by untwisting the balloon for rapid deflation of all chambers at once.

The second method is to include a manifold in the continuous balloon structure that incorporates self-sealing valves where the manifold has fluid communication with each inflatable chamber or group of chambers. All chambers (or groups of chambers) connected to the manifold could be inflated at once, but the self-sealing valves would keep one chamber (or group of chambers) from leaking just because of a leak in another, connected chamber (or group of chambers). This can be achieved by the same general process described earlier in which a plurality of die applications are made to a plurality of layers of film in such a way as to establish fluid communication between chambers created by the die applications. A manifold was suggested and illustrated in the original form of this application. We are simply specifying the inclusion of separate self-sealing (check valves) for each inflatable chamber as a method of preventing the deflation of all inflatable chambers in the system when one develops a leak. This method does give up the ease of deflating all chambers at once when desired.

The third method is to manufacture inflatable chambers in a connected series through a plurality of die applications to a plurality of layers of film but without fluid communication between the chambers. Such a continuous balloon structure can save time and material otherwise required for assembly of a balloon display. It can also assure the relative placement of inflated chambers within the display. It does give up the advantage of inflating all the chambers at once and the advantage of deflating all chambers at once when desired.

All three of these methods have a common procedure for producing a plurality of connected inflatable chambers. They all use a plurality of die applications to a plurality of layers of film. This common procedure readily incorporates other dependent innovations taught in the original form of this application such as: 1. use of three or more layers of film. 2. seal facilitating and seal inhibiting treatments to various surface areas of layers of film used, and 3. differences in cut patterns for various layers of film used. These three innovations may be used to create pockets, portals, and passageways for other objects that may have informative, decorative and/or structural value to the finished display. Much of the related discussion and descriptions incorporated herein by reference from earlier applications use the term "balloon system" when referring to connected inflatable chambers with fluid communication. The current discussion and claims include connected inflatable chambers with fluid communication and without fluid communication. In the current descriptions and discussions we use the term "continuous balloon structures" to incorporate both connected inflatable chambers with fluid communication and without fluid communication.

"Balloonlet" is often used in referenced, earlier discussions and descriptions when referring to connected inflatable chambers, especially when they are in fluid communication and appear to be distinct balloons. The current discussion and claims incorporate such inflatable chambers and inflatable chambers that do not have such fluid communication and that may not give the appearance of distinct balloons. "Inflatable chambers" is more often used even when referring to items with "balloonlet" characteristics.

BRIEF DESCRIPTION OF THE SEVERAL VIEWS OF THE DRAWINGS

In the drawings:

FIG. 7 is a plan view of a continuous balloon structure according to an alternative preferred embodiment of the present invention with inflatable chambers that are made with multiple dies including terminal dies that may be used only at specified ends of the continuous balloon structure.

FIG. 8 is a plan view of a die configuration that produces a cluster of inflatable chambers with a single die impression.

FIG. 9 is a plan view of a continuous balloon structure according to an alternative preferred embodiment of the present invention with the continuous balloon structure composed of a series of inflatable chamber clusters.

FIG. 16*a* shows a die configuration with openings on opposite ends.

FIG. 16*b* shows the result of four applications of this die on a plurality of layers of film FIG. 16*c* shows these chambers after inflation.

FIG. 16*d* shows these chambers after inflation and after the termination of fluid communication between chambers. Termination is made with a flat seal at the line of overlap of the die applications.

FIG. 16*e* shows these chambers after inflation and the termination of fluid communication between chambers by means of twisting the narrow connection between chambers.

FIG. 16*f* shows a cross section of film in FIG. 16*b* when there are two layers of film involved.

FIG. 16*g* shows a cross section of film in FIG. 16*b* when there are four layers of film involved.

FIG. 16*h* shows a cross section of film in FIG. 16*c*, 16*d* or 16*e* when there are two layers of film involved, and the continuous balloon structures is inflated.

FIG. 16*i* shows a cross section of film in FIG. 16*c*, 16*d*, or 16*e* when there are four layers of film involved and the air chambers between the top two layers of film and the air chambers between the bottom two layers of film are inflated with approximately equal pressure.

FIG. 16*j* shows a cross section of film in FIG. 16*c*, 16*d*, or 16*e* when there are four layers of film involved and the air chambers between the middle two layers of film are inflated.

FIG. 17*a* shows a die configuration with a single opening and two sealed appendages.

FIG. 17*a*1 shows the area of a single set of seals from a die impression.

FIG. 17*b* shows the result of four applications of this die configuration on a plurality of layers of film in which the die applications touch or overlap slightly at the seal thereby creating a connected series of inflatable chambers without fluid communication between the inflatable chambers.

FIG. 17*b*1 shows the area of all seals in the continuous balloon structure.

FIG. 17*c* shows the four chambers inflated.

FIG. 17*d* shows a cross section of film in FIG. 17*b* when here are two layers of film involved.

FIG. 17*e* shows a cross section of film in FIG. 17*b* when there are four layers of film involved.

FIG. 17*f* shows a cross section of film in FIG. 17*c* when there are two layers of film involved, and the continuous balloon structures is inflated.

FIG. 17*g* shows a cross section of film in FIG. 17*c* when there are four layers of film involved and the air chambers between the top two layers of film and the air chambers between the bottom two layers of film are inflated with approximately equal pressure.

FIG. 17*h* shows a cross section of film in FIG. 17*c* when there are four layers of film involved and the air chambers between the middle two layers of film are inflated.

FIG. 18*a* shows a die configuration incorporating a manifold for inflating the chamber and for connecting chambers.

FIG. 18*b* shows the result of four applications of this die on a plurality of layers of film.

FIG. 18*c* shows the four chambers inflated.

FIG. 19*a* shows a die configuration incorporating a manifold for inflating the chamber and for connecting chambers.

FIG. 19*b* shows the result of four applications of this die on a plurality of layers of film with self-sealing valves inside.

FIG. 19*c* shows the four chambers inflated with the self-sealing valves hidden inside.

FIG. 20*a* shows a die configuration with appendages on each end.

FIG. 20*b* shows two layers of film with a manifold between them and the manifold including self-sealing valves.

FIG. 20*c* shows the result of four applications of this die on the two of layers of film.

FIG. 20*d* shows the four chambers inflated with the manifold and self-sealing valves hidden inside.

FIG. 21*a* shows a die configuration with openings on opposite ends.

FIG. 21*b* shows three layers of film. The top layer has cut outs in the shape of five pointed stars.

FIG. 21*c* shows the result of four applications of this die on the three layers of film.

FIG. 21*d* shows the chambers inflated.

FIG. 22*a* shows a die configuration with openings on opposite ends.

FIG. 22*b* shows three layers of film. The top layer has cut outs on the edges.

FIG. 22*c* shows the seal pattern resulting from four applications of this die on the top and middle layers of film. This figure also shows example paths that linear objects might take through the openings between the layers.

FIG. 22*d* shows the seal pattern resulting from four applications of this die on the middle and bottom layers of film.

FIG. 22*e* shows the layers from above after inflation along with the object paths shown in FIG.22*c*.

FIG. 22*f* shows a cross section of FIG. 22*e*.

FIG. 23*a* shows a die configuration with openings on opposite ends.

FIG. 23*b* shows four layers of film. The third layer down has been treated in strips on the top side of the film to resist being sealed to the second layer of film.

FIG. 23*c* shows the seal pattern resulting from four applications of this die on the first and second layers of film.

FIG. 23*d* shows the seal pattern resulting from four applications of this die on the second and third layers of film. This figure also shows example paths that linear objects might take through the openings between layers two and three.

FIG. 23*e* shows the seal pattern resulting from four applications of this die on the third and fourth layers of film.

FIG. 23*f* shows the layers from above after inflation along with the object paths shown in FIG.23*d*.

FIG. 23*g* shows a cross section of FIG. 23*f*.

FIG. 24*a* shows two die configurations.

FIG. 24*a*1 shows the area of both die configurations.

FIG. 24*b* shows three layers of film. The middle layer has circular cutouts.

FIG. 24*c* shows the seal pattern resulting from two applications of each of the two dies.

FIG. 24*c*1 shows the area encompassed by a line that traces the outermost reaches of all sets of seals from die impressions 370 and 371.

FIG. 24*d* shows the layers from above after inflation.

FIG. 24*e* shows a cross section of FIG. 24*d*.

FIG. 25*a* shows a star shaped die configuration with five openings.

FIG. 25*a*1 shows the area of the die configuration in 25*a*.

FIG. 25*b* shows a star shaped die configuration with four openings.

FIG. 25*b*1 shows the area of the die configuration in 25*b*.

FIG. 25*c* shows a continuous balloon structure resulting from applications of die configurations in 25*a* and 25*b*.

FIG. 25*c*1 shows the area of the continuous balloon structure in 25*c*.

FIG. 26*a* shows a rectangular die configuration.

FIG. 26*a*1 shows the area of the die configuration in 26*a*.

FIG. 26*b* shows a continuous balloon structure that results from three application of the die configuration in 26*a* to a plurality of layers of film.

FIG. 26*c* shows a continuous balloon structure that results from three application of the die configuration in 26*a* to a plurality of layers of film where there is significant overlap of the die impressions.

FIG. 26*d* shows a continuous balloon structure that results from three application of the die configuration in 26*a* to a plurality of layers of film where there is more overlap of the die impressions.

FIG. 26*e* shows a continuous balloon structure that results from three application of the die configuration in 26*a* to a plurality of layers of film where die impressions overlap by half their length.

FIG. 26*e*1 shows the area of the continuous balloon structure formed in 26*e*.

FIG. 27*a* shows a die configuration with a manifold and inflatable chamber design.

FIG. 27*b* shows a heart shaped balloon with an inflation stem.

FIG. 27*c* shows two layers of film with a array of heart shaped balloons between them.

FIG. 27*d* shows the results of four die impressions upon the film layer with the heart shaped balloon between them.

FIG. 28*a* shows a square shaped die configuration with four openings.

FIG. 28*b* shows two layers of film with a continuous balloon structure between them.

FIG. 28*c* shows the results of four die applications upon the two layers of film with the continuous balloon structure between them.

FIG. 29*a* shows a die configuration.

FIG. 29*b* shows four layers of film that include one with a seal resistant coating.

FIG. 29*c* shows the results of four die applications on the top two layers of film.

FIG. 29*d* shows the results of four die applications on the middle two layers of film.

FIG. 29*e* shows the results of four die applications on the bottom two layers of film.

FIG. 29*f* shows the results of inflation.

DETAILED DESCRIPTION OF INVENTION

Figure 1:
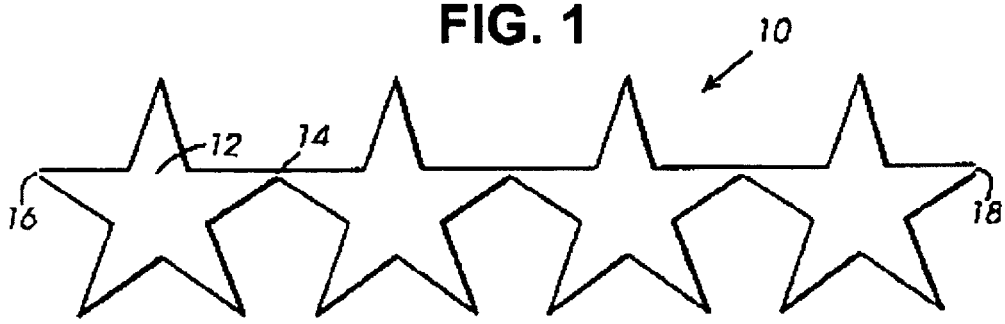
FIG. 1 is a plan view of a continuous balloon structure according to a preferred embodiment of the present invention with inflatable chambers in direct connection.

The present claims address a continuous balloon structure and a method for making continuous balloon structures. This structure would most often be inflated with gas, sealed and used as a balloon display with decorative, informative and/or structural value. It may, however, be used without the chambers being filled or with chambers filled with other fluids. The structure might also be used as a conduit, carrier or wrap for fluids, particles, objects, light, sound, electricity, electronic impulses, etc.

The continuous balloon structure is a plurality of connected inflatable chambers that are formed from a plurality of layers of film by a plurality of die applications. Die applications create sets of seals between layers of film. The area encompassed by all seals is greater than the area encompassed by any single set of seals.

The continuous balloon structure can be in the form of a linear, arcuate or circular sequence of inflatable chambers, or a variety of two and three dimensional solid or shell configurations, and the number of inflatable chambers comprising the continuous balloon structure may be quite large.

Traditionally, one thinks of a die as cutting or forming hardware approximately the size of the product to be made. When the die is applied, the product is cut or formed from a larger, unshaped material. However, the present invention contemplates that there may be and will be other ways of making a shaped or cut product from uncut, unshaped materials in addition to mechanical stamping or cutting. We intend our use of the term "die" to include those technologies for making impressions, cutting, and sealing film layers together whether they are very much like current mechanical dies or combinations of plotters, lasers, and robotics, or other technologies. Furthermore, a die also includes the software or programming that controls the hardware as an integral part of the total "die" since, the software determines when and where the impression is made.

It is also traditional in the art of balloon display systems to think of heat-sealing as the method of bonding layers of film and to think of heat-cutting as the method of separating the balloon portion of the film from the non-balloon portion of the film. In this patent application we conceive of "sealing" and "cutting" to include mechanical, chemical, heat, and all other forms of bonding and separating appropriate portions of the film.

It is also traditional in the art to think of "the balloon" as being made only from portions of film cut out of the larger sheets of film. In this patent application we conceive of "the balloon" to be the inflatable portion of the film regardless of whether the inflatable portion is the portion cut out of a larger section of film or the portion that remains after a portion is cut out and discarded.

In one embodiment a continuous balloon structure made with these methods may be constructed to have as many inflatable chambers as there is material for making the system. The openings at one end of the system may be sealed and the entire array of inflatable chambers inflated at once from the remaining open end. The entire array of inflatable chambers may then be sealed at once at the remaining open end. The entire array of inflatable chambers may be installed as a group for many forms of decorating. The entire array of inflatable chambers may be deflated at once by opening only one end of the continuous balloon structure. The entire array of inflatable chambers may then be rolled up and stored.

In the present invention, the continuous balloon structure is often made by repeated, sequential application of a die to the balloon material. Preferably, the balloon material, whether rubber or plastic or some other suitable inflation-gas-impermeable, resilient material wound onto spools, is removed from the spools and runs under a single die that is repeatedly applied. Each application of the die defines an inflatable chamber and each inflatable chamber is connected by the shape of the die and the rate of material movement with the next inflatable chamber so that all the inflatable chambers are in fluid communication so that, when the first end of the first inflatable chamber is sealed, all the inflatable chambers can be inflated by blowing gas into the second end of the last inflatable chamber. Alternatively, both ends can be sealed and a valve inserted at some location anywhere in the system.

In other embodiments of the present invention multiple die impressions may be required to define a single inflatable chamber or a single die impression may define a plurality of inflatable chambers. In yet other embodiments of the present invention connected inflatable chambers defined by a plurality of die impressions may not have fluid communication.

The use of plastic balloon material with the present method of repeated application of at least one die to produce inflatable chambers forming a continuous balloon structure is another important feature of the present invention. The continuous balloon structure depends naturally on the integrity of the balloon material, because a leak in anyone inflatable chamber is a leak in the entire system. Therefore, the use of better balloon material, such as nylon or polyester film, allows significantly greater confidence that a non-leaking continuous balloon structure according to the present invention can be made. Moreover, the fact that the present system can be easily deployed and taken down (i.e., deflated) for reuse, would justify the higher cost for premium materials.

For purposes of this application, however, we would consider "films" more broadly to include other relatively thin sheets of materials from which inflatable chambers might be made. This could include but not be limited to papers, fabrics, vinyl, latex, synthetic rubber and even metals. While nylon and polyester might be preferred currently, changing technology and specialized markets might affect future preferences.

The present invention's various features—easily made arrays of inflatable chambers and clusters of inflatable chambers—work together to enable those who specialize in balloon decorations to create more elaborate, more fanciful balloon decorations and to set them up and take them down faster, more cheaply, and with less skilled help. The present invention's various features will also allow non-specialists and many consumers to decorate in ways that would not previously be practical for them and to do them with consistently good results.

This application claims continuous balloon structures that include a combination of three or more layers of film. These configurations of continuous balloon structures contain at least one inflatable chamber between two layers of film and at least one additional layer of attached film. Some variations of these configurations include multiple layers of film that are first given appropriate combinations of coatings of seal-facilitating, seal-inhibiting, and decorative materials in especially configured, pre-designated patterns on the surfaces of the layers. In some cases, patterns of cuts or holes may be made to some of the layers. The layers are then placed on each other in registration on a carrier surface for the die impressions to be made in order to seal and cut the predetermined points, lines and areas of film. By virtue of differences in the type and locations of coating treatments and in the differences in the cuts and holes in the layers of film, the process of die sealing and cutting will produce a three-dimensional structure with horizontal and vertical interconnected passages, openings, and chambers defined by sealed boundaries, slits and holes. This three-dimensional form is a continuous balloon structure having the desired shape given by the designer.

Referring now to FIG. 1, there is shown a continuous balloon structure made according to a preferred embodiment of the present invention and generally indicated by reference numeral 10. Continuous balloon structure 10 has a first end 16 and a second end 18. In this embodiment, continuous balloon structure 10 is made by a repeated application of a star-shaped die in such a way that star-shaped inflatable chambers 12 have fluid communication through contacts 14. These contacts 14 are made by a slight overlap of the points on the opposing sides of each inflatable chamber 12. While five pointed star shapes with two open ended points are illustrated here; any desired shape might be used as long as it allows for fluid communication between inflatable chambers 12 through contacts 14.

There is a risk that premature deflation of any one of the star shaped inflatable chambers 12 would lead to the deflation of the other star shaped inflatable chambers 12. This risk can be eliminated by terminating fluid communication between inflatable chambers 12 after they are inflated. Fluid communication between chambers may be terminated at connection points 14 or at other places between first end 16 and second end 18. The termination could be made by another die impression upon the specific areas chosen to seal off fluid communication. The termination could be made by clamps or by other pressure devices upon the specific areas chosen to seal off fluid communication. Twisting the continuous balloon structure could also make the termination.

Once inflated it would ordinarily be best to minimize the amount of fluid displaced by the termination technique chosen. Compared to traditional latex balloons, film balloons are relatively inelastic. If one of the inflatable chambers were completely squeezed through an area of maximum volume, it might burst the chamber. Areas of minimum volume such as the illustrated connection points 14 would normally be preferred.

Figure 2:
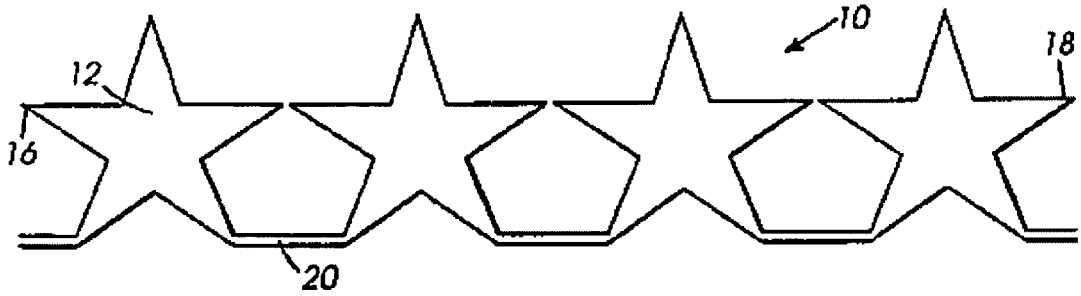
FIG. 2 is a plan view of a continuous balloon structure according to an alternate preferred embodiment of the present invention with inflatable chambers connected through hollow stems.

Referring now to FIG. 2, each star inflatable chamber 12 between first end 16 and second end 18 of continuous balloon structure 10 is connected at its lower points by a conduit 20. As in FIG. 1 there is a risk of deflation of all chambers 12 if a leak occurs in any one of the chambers 12. The risk may be eliminated by terminating fluid communication between inflatable chambers after inflation. This step, however, also takes away the ease of deflation of all chambers that is present when fluid communication between inflated chambers remains in tact.

Figure 3:
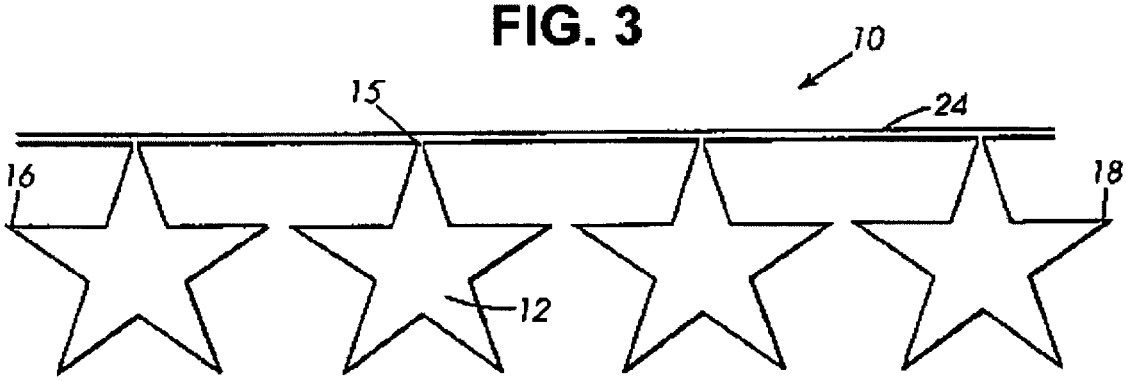
FIG. 3 is a plan view of a continuous balloon structure according to an alternative preferred embodiment of the present invention with inflatable chambers connected through a common manifold.

Referring now to FIG. 3 shows a second alternative connection for inflatable chambers 12 between first end 16 and second end 18 of continuous balloon structure 10. Each chamber 12 is in fluid communication with a manifold 24 that, in turn, gives fluid communication among all chambers 12 through openings 15. After inflation, fluid communication could be terminated at openings 15, along manifold 24 or at less desirable locations within the star shapes.

Figure 4:
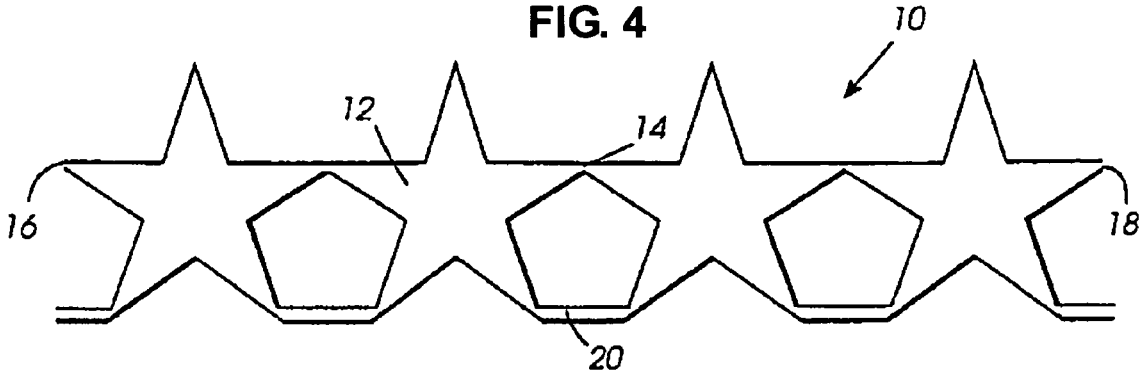
FIG. 4 is a plan view of a continuous balloon structure according to an alternative preferred embodiment of the present invention with inflatable chambers that have multiple connections to adjacent inflatable chambers.

Referring now to FIG. 4, uses both contacts 14 and conduits 20 to connect inflatable chambers 12 between first end 16 and second end 18 of continuous balloon structure 10. Other combinations of direct contacts 14, conduits 20 and manifolds 24 are also possible but not illustrated.

It will be clear that any number of inflatable chambers 12 may be strung in a row simply by a sufficient number of applications of the inflatable chamber die. It will be equally clear that the die, in whatever shape it is configured, will produce fluid communication among connected inflatable chambers as long as it provides for either contact 14, conduit 20 or manifold 24 in its shape to be on the inlet and opposing outlet sides of each inflatable chamber, and to be oriented so that the outlet of a first inflatable chamber connects automatically with the inlet of the next inflatable chamber.

Continuous balloon structure 10 may be stored in a roll or layers and later cut into a desired number of shorter continuous balloon structures of equal or different lengths. Each system may be sealed at first end 16 and then inflated through and sealed at second end 18 for use. After use, one end or other point in the system, may be cut open and the whole system deflated and stored for repeat use.

Figure 5:
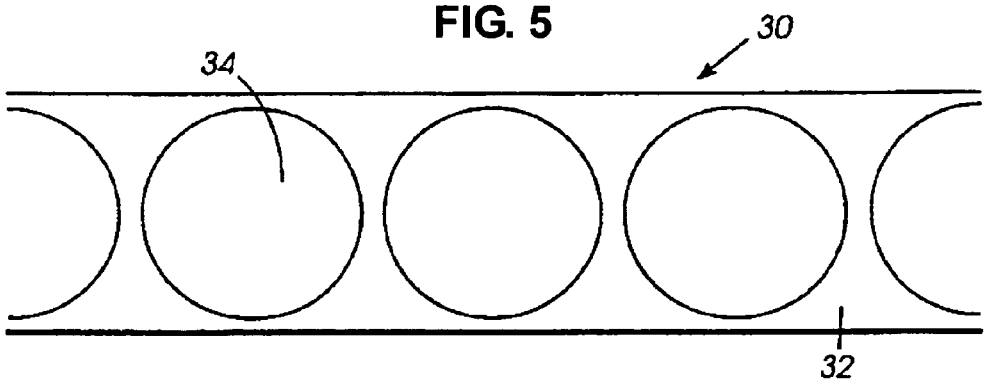
FIG. 5 is a plan view of a continuous balloon structure according to an alternative preferred embodiment of the present invention with inflatable chambers that surround portions of the film that are cut out or left as uninflated panels.

Referring now to FIG. 5, there is shown an alternative preferred embodiment of a continuous balloon structure 30 made according to the present invention. In this embodiment, a balloon die in the shape of a banner 32 with circular holes 34 cut out (or simply to be left uninflated) is repeatedly applied to the balloon material. While it is anticipated that the inflatable chamber shape will most often be a recognized "positive form" such as a star, square, circle, etc., as illustrated in the star-shaped inflatable chambers 12 of FIGS. 1-4, FIG. 5 illustrates that the inflatable chamber can also be the surrounding structure which defines a more recognizable "negative form" such as a hole in the shape of a circle, star, square, etc., cut in an inflatable panel.

Figure 6:
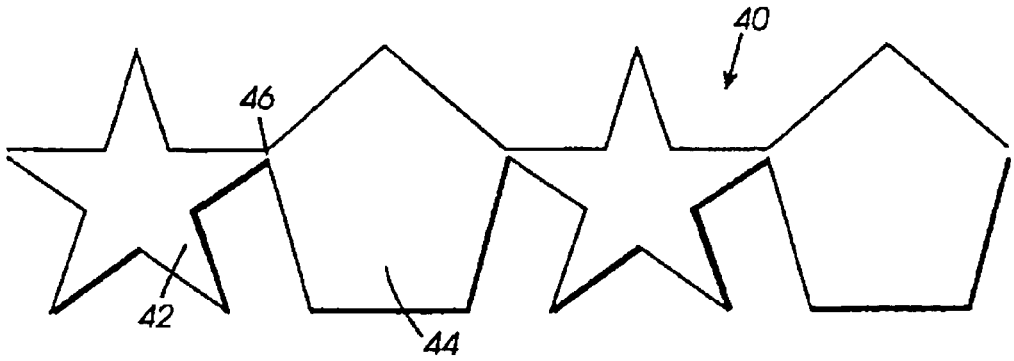
FIG. 6 is a plan view of a continuous balloon structure according to an alternative preferred embodiment of the present invention with inflatable chambers that are made with multiple dies.

Referring now to FIG. 6, there is shown an alternative preferred embodiment of a continuous balloon structure 40 according to the present invention. In this embodiment, continuous balloon structure 40 is composed of an alternating series of inflatable chambers 42 and 44. Inflatable chamber 42 is in the shape of a five-pointed star; inflatable chamber 44 is in the shape of a pentagon. Each inflatable chamber 42, 44, is connected by contacts 46 with the inflatable chambers on either side of it so that all inflatable chambers 42, 44, of continuous balloon structure 40 are in fluid communication and constitute, in fact, one balloon.

It will be clear that a single die having both a five-pointed star and an adjacent, connected pentagon could have been made and repeatedly applied to make the same continuous balloon structure 40. It will also be clear that any sequence, repeated sequence or random sequence, of dies forming inflatable chambers of different shapes could be used to make a single continuous balloon structure with fluid communication provided that all dies form shapes that have overlapping inlets and outlets to allow contacts 14, as illustrated in FIG. 1; conduits 20, as illustrated in FIG. 2; manifolds 24, as illustrated in FIG. 3; or combinations of these, as illustrated in FIG. 4.

Referring now to FIG. 7, there is shown an alternative preferred embodiment of a continuous balloon structure 50 according to the present invention. This embodiment illustrates how a continuous balloon structure can be made by the application of different dies in such a way as to create inflatable chambers that spell the word "Yes". Each letter, "y", "e", "s", plus an end cap, is a separate inflatable chamber 52, 54, 56, and 58. All are in fluid communication provided that the dies are configured so that the inflatable chambers are in fluid communication when cut in the preselected series.

Die impressions can be made to be "universal" in that they may be arranged in any order desired and repeated as many times as desired within the continuous balloon structure illustrated and can still produce fluid communication among the inflatable chambers. End cap 58 of continuous balloon structure 50 also illustrates functional components of a continuous balloon structure. A die does not have to make only ornate inflatable chambers, but can alternatively impress the balloon material with shapes for functional considerations, such as stems, end caps, conduits for creating spaces between inflatable chambers, tie straps, and so on. But some portions of the die impression can incorporate functional features along with ornamental features.

Referring now to FIG. 8, there is shown a cluster 62 of inflatable chambers 64 made with a single die impression. The star shaped chambers 64 have fluid communication with adjacent star shaped chambers in the cluster through openings 66. The cluster has outlets 68 that allow inflation and fluid communication with other such clusters as shown in FIG. 9.

Referring now to FIG. 9, there is shown yet another continuous balloon structure 60. Continuous balloon structure 60 is comprised of a connected series of inflatable clusters 62 with fluid communication through openings 68. Filling any one of the clusters with air or helium will begin to fill them all. Although intricate and appearing to be possibly hundreds of balloons depending on the length of continuous balloon structure, continuous balloon structure 60 is one continuous balloon.

Each star 64 is connected to two adjacent stars 64 at the tips of two of its adjacent points 66 both for fluid communication and orientation. Not only will that connection allow the balloon-filling gas to circulate from one star chamber to the next; it also orients one star 64 to the next one so that the ring is formed. In each inflatable cluster 62, two stars on each side have additional points 68 that are in fluid communication with the next inflatable chamber 62.

Referring now to FIG. 10 shows a plan view of multiple continuous balloon structures according to an alternative preferred embodiment of the present invention with a single die used to simultaneously produce the multiple continuous balloon structures.

Figure 10A:
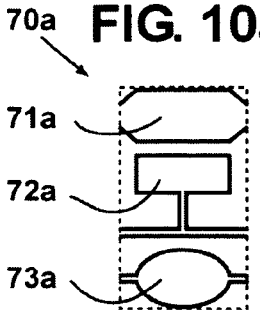
FIG. 10 is a plan view of multiple continuous balloon structures according to an alternative preferred embodiment of the present invention with a single die used to simultaneously produce the multiple continuous balloon structures.

FIG. 10*a* illustrates a single die configuration 70*a* bounded by the dashed line. The top section of the die impression 71*a* defines a single, inflatable chamber in an oblong shape. The middle section 72*a* defines a single, rectangular, inflatable chamber with a manifold and connecting vertical stem. The lower section 73*a* defines an oval, inflatable chamber with open stems to the left and right.

Figure 10B:
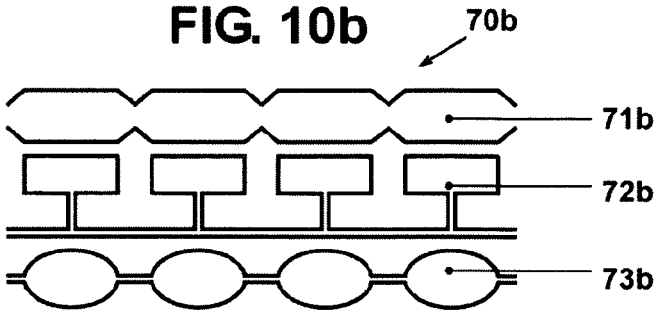
Figure 11:
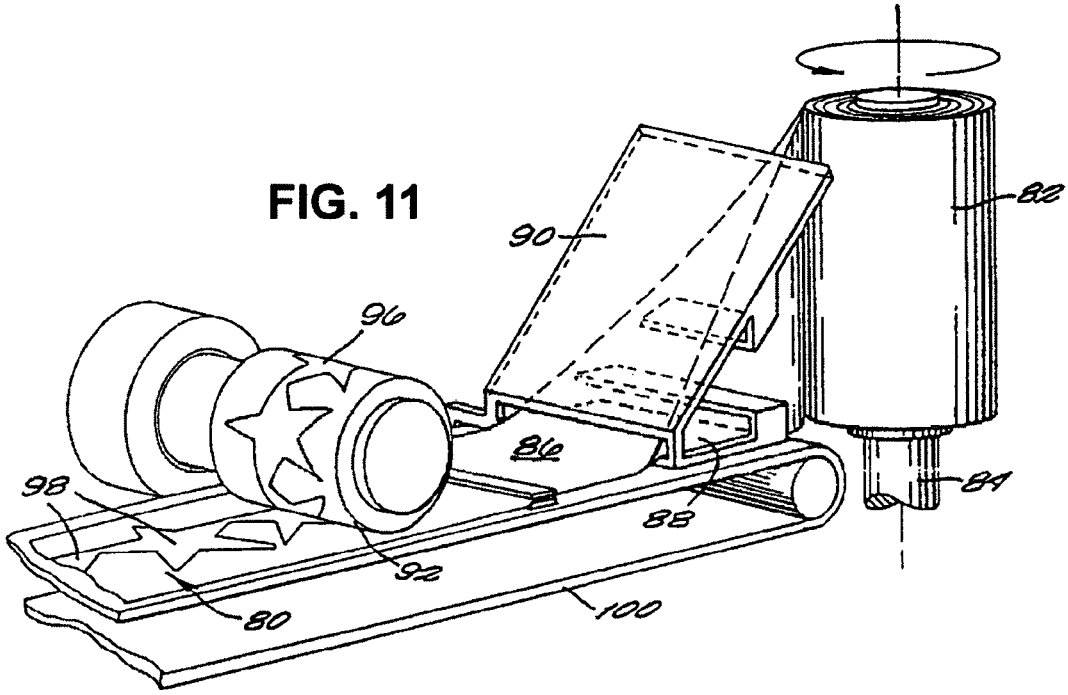
FIG. 11 is a perspective view of the manufacture of a continuous balloon structure according to a preferred embodiment of the present invention using a rotary die.

FIG. 10*b* shows the result 70*b* of four, sequential impressions of 70*a* spaced so that each new impression just touches or overlaps slightly the previous impression on a plurality of layers of film. The result is a set of three parallel but independent continuous balloon structures 71*b*, 72*b* and 73*b* Referring now to FIG. 11, there is shown a method for making continuous balloon structure 80 according to a preferred embodiment of the present invention. The method of manufacture includes the step of unwinding a continuous roll of inflation-gas-impermeable film 82 from a spool 84 and folding film 82 to form an upper sheet 86 and a lower sheet 88. (Alternatively, multiple spools of suitable film may supply layers of film without the necessity of folding.) Preferably, film 82 is made of nylon or polyester film, but any resilient film that is generally impermeable to the inflating gas and strong enough to resist punctures could be satisfactory. The fold is made by angled member 90; however, any suitable folding device may be used. A roller die 92 is then applied to the two layers of folded film 82 to define inflatable chambers 98 and to seal upper to lower sheet. Roller die 92 has several die cuts 96, shown as producing inflatable chambers 98 in the shape of stars in this example, as film 82 is conveyed by conveyor 100; however, it will be appreciated that die cuts 96 may come in any desired shape. Moreover, roller die 92 may be interchanged with another roller die having differently shaped die cuts about its circumference. In this way, continuous balloon structure 80 can be comprised of a variety of differently shaped inflatable chambers 98. Importantly, however, each inflatable chamber must be connected with the next inflatable chamber by the same material from which they are formed. In some preferred embodiments there will be fluid communication between inflatable chambers while in other embodiments there will not. Yet other embodiments may include both inflatable chambers with fluid communication to other such chambers and inflatable chambers without fluid communication to other inflatable chambers.

Figure 12:
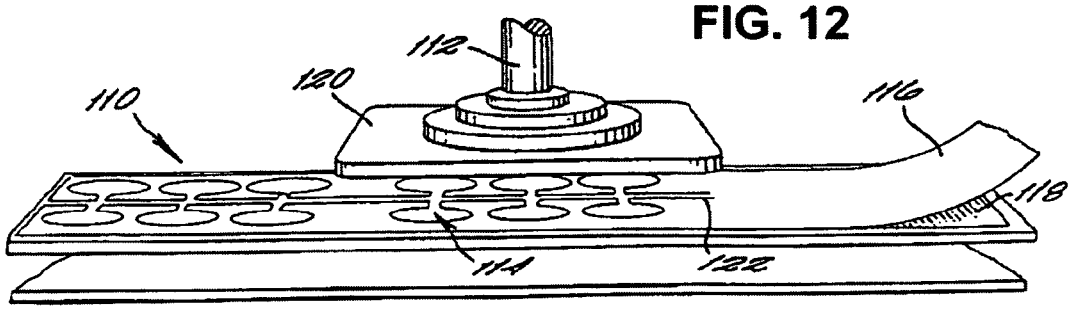
FIG. 12 is a perspective view of the manufacture of a continuous balloon structure according to an alternative preferred embodiment of the present invention using a flat die.

Referring now to FIG. 12, there is shown an alternative process for making continuous balloon structure 110 according to a preferred embodiment of the present invention. Continuous balloon structure 110 is made using a flat press 112 making an inflatable chamber cluster 114. In this process, film layers 116 and 118 are brought under a die 120 carried by flat press 112 wherein a cluster 114 including a portion of connecting stem 122 is formed with one application of die 120. Repeated applications of die 120 yield continuous balloon structure 110 limited only by the amount of film.

Sealing of upper and lower film layers 116, 118, respectively, is preferably achieved by heat sealing using heat directly applied by die 120 or with a laser; however, it is to be appreciated that crimping, chemical bonding by treating the film in the appropriate areas with a solvent or glue could also accomplish this task. Solvent or adhesives may be applied to upper or lower film layers 116, 118, respectively, or both, as desired. It is also recognized that, while this figure shows two layers of film, multiple layers of film could be used productively in this system. The balloon is then trimmed of excess film and may be decorated in accordance with known balloon manufacturing procedures such as printing or silk screening. Such decorations could be done before, after, or both before and after the processing described here.

Figure 13:
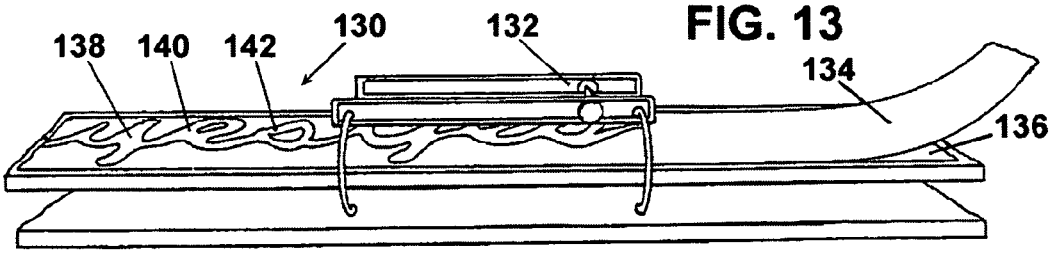
FIG. 13 is a perspective view of the manufacture of a continuous balloon structure according to an alternative preferred embodiment of the present invention using a plotter die.

Referring now to FIG. 13 there is shown an alternative process for making a continuous balloon structure 130 according to a preferred embodiment of the present invention. This illustration shows a laser plotter 132 making continuous balloon structure 130, which is in the form of the word "yes" as described in FIG. 7 repeatedly. In this process, film layers 134,136, are brought under laser plotter 132 so that inflatable chambers 138 ("y"), 140 ("e"), and 142 ("s") are formed in sequence and then the sequence repeated as often as desired.

As defined above, "die" includes mechanical dies and laser plotters, which is a heat laser that is directed toward the layered balloon material and applies heat for a sufficient amount of time to melt the two layers together to form a gas-proof seal. Laser plotter 132 is computer controlled and seals film layers 134 and 136 together wherever it is directed by a computer (not shown). For complex inflatable chambers, complex series of different inflatable chambers, and to generate new "dies" quickly; a computer controlled laser plotter is preferred.

Sealing of film layers 134,136, respectively, is preferably achieved as described above, by heat sealing using a laser or with heat directly applied; however, it is to be appreciated that crimping, chemical bonding with a solvent and adhesion with a glue could also accomplish this task.

Continuous balloon structures can be supported in a number of ways such as tension applied to the ends of the system, perhaps augmented by ties connected to the continuous balloon structure along its length. Helium, for example, is frequently used to float balloons and can be used to good effect in a continuous balloon structure according to the present invention. However, two functional features can be incorporated into each inflatable chamber's shape that will help to align the inflatable chambers with respect to each other. Both relate to the avoidance of effects that would otherwise occur to the inflatable chambers when inflated but that are not evident from the uninflated balloon. These are illustrated in FIGS. 14*a* and 14*b* and FIG. 15.

Figure 14A:
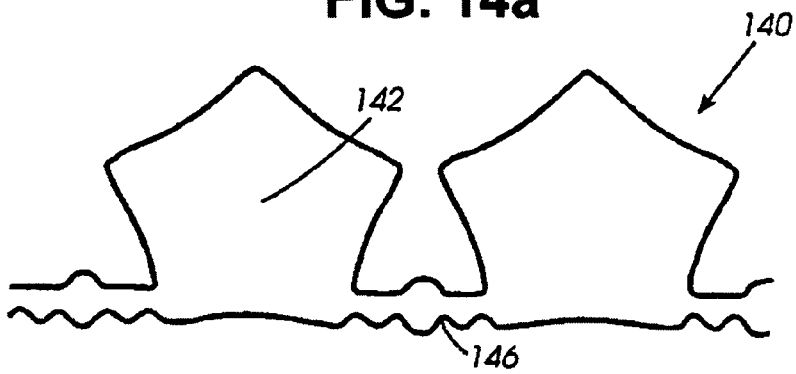
FIGS. 14A and 14B illustrate uninflated and inflated side views of a series of inflatable chambers that form an arched array of inflatable chambers made according to a preferred embodiment of the present invention.
Figure 14B:
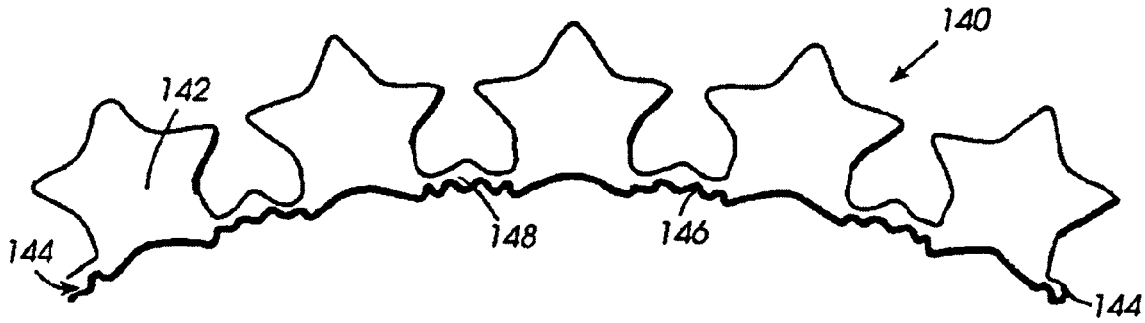

FIGS. 14*a* and 14*b* illustrate an uninflated and inflated continuous balloon structure 140 in the form of a row of star-shaped inflatable chambers 142 which are designed to form an arch when inflated with helium and when the ends 144 are tied down. FIG. 14*a* shows two adjacent inflatable chambers 142 as they would be produced by an appropriate die (not shown). Note that the star shape when inflated is best effected by an almost pentagonal shape in the uninflated inflatable chamber because, when the inflatable chamber puffs up as it fills with gas, the inwardly curving sides are pulled further inward. To force continuous balloon structure 140 to arch properly, notches 146 are formed in connectors 148. These inwardly curving notches 146 are drawn inwardly even more when the connectors 148 themselves puff up.

Thus, connector 148 curves to orient adjacent inflatable chambers 142 in an arch. The depth and number of notches 146 determine in part the curve of the arch.

Figure 15:
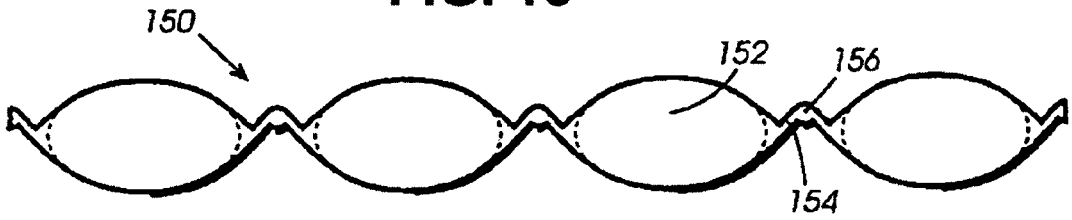
FIG. 15 illustrates a technique for maintaining the alignment of a row of inflatable chambers according to a preferred embodiment of the present invention.

The second feature that can be incorporated into each inflatable chamber that is functional and that helps with alignment is a small chamber in the connector, as illustrated in FIG. 15. There is a tendency of a string of inflatable chambers to "zigzag" with respect to each other and to lean with respect to each other.

Continuous balloon structure 150 is illustrated as being made up of oval inflatable chambers 152 in this example. Included with each inflatable chamber 152 is a stem 154 that connects inflatable chambers and enables the fluid communication between them. By forming an expansion or chamber 156 in stem 154 that is larger than the stem, the leaning and zigzagging is neutralized because chamber 156 acts as a miniature inflatable chamber between each inflatable chamber 152. Thus, all inflatable chambers 152 zigzag and lean the same way and all chambers 156 zigzag and lean the opposing way but are virtually invisible because of their small size. The net effect is that all inflatable chambers 152 appear to be in alignment.

Referring now to FIG. 16, it shows a continuous balloon structure with fluid communication between adjacent inflatable chambers and its formation according to a preferred embodiment of the present invention.

Figure 16A:
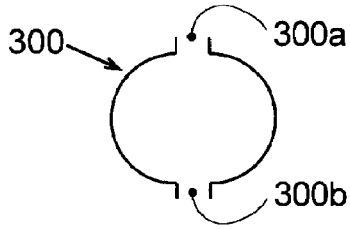
FIG. 16*a*-16*j* shows a continuous balloon structure and its formation according to a preferred embodiment of the present invention.

FIG. 16*a* shows the die configuration 300 with openings 300*a* and 300*b* at opposite ends. The die configuration shown is basically circular, but might be any shape, including shapes which include smaller inflatable chambers within its borders, as long as at least two openings can be matched during multiple applications of the die. The area defined by die configuration 300 is the area circumscribed by lines 300 and imaginary straight lines across end openings 300*a* and 300*b*.

Figure 16B:
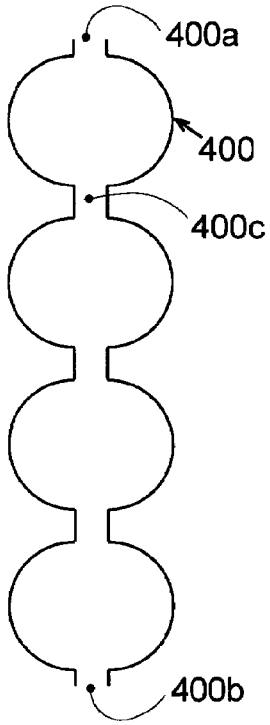

FIG. 16*b* shows the result of four applications of this die on a plurality of layers of film. The lines 400 represent seals between adjacent layers of film that correspond to lines 300 of the die configuration in FIG. 16*a* that made the seals. The die applications touch or overlap slightly at the openings 400*c* thereby creating a connected series of inflatable chambers between open ends 400*a* and 400*b* with fluid communication between chambers in the linear series. While, the results of four die applications are illustrated, there might be any plurality of such die applications. Four connected chambers 400 are shown but there might be any quantity of two or more such connected, inflatable chambers. The area defined by all die impressions is the area circumscribed by all lines 400 and imaginary straight lines across end openings 400*a* and 400*b*.

Figure 16C:
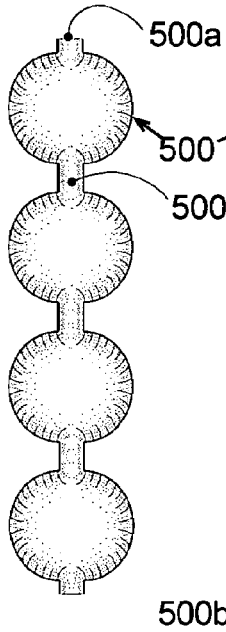

FIG. 16*c* shows the effect of inflation. The inflated chambers 500 are connected at contacts 500*c* between ends 500*a* and 500*b*. In order to retain the inflated state these ends would be closed. This is an example of a continuous balloon structure with a first end 500*a* and a second end 500*b* to the sets of seals wherein the first end and the second end are not contiguous and there is fluid communication between/among a plurality of inflatable chambers.

Figure 16D:
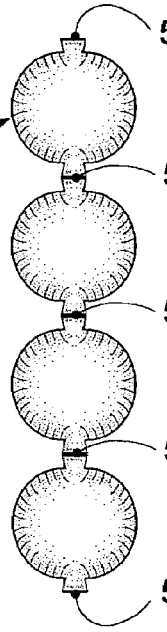

FIG. 16*d* shows the inflated, continuous balloon structure after the ends have been closed and relabeled as 500*e* and 500*f*. The fluid communication through chamber connections at 500*c* have been terminated by flat seals and relabeled as 500*d*. The seals at 500*d* have been made either with die applications or pressure clamps. This is an example of a continuous balloon structure with a first end 500*e* and a second end 500*f* to the sets of seals wherein the first end and the second end are not contiguous and there is no fluid communication between/among a plurality of inflatable chambers.

Figure 16E:
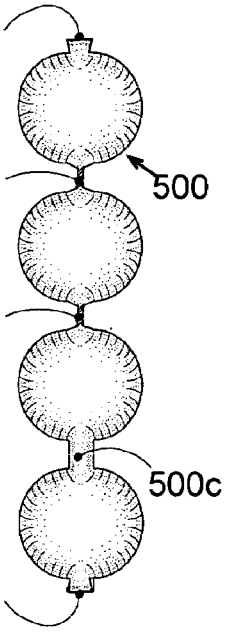

FIG. 16*e* shows the inflated, continuous balloon structure in a status similar to FIG. 16*d* except that the termination of fluid communication at 500*d* is made by twisting the balloon structure and the connection at 500*c* is left open for fluid communication between chambers. This is an example of a continuous balloon structure with a first end 500*e* and a second end 500*f* to the sets of seals wherein the first end and the second end are not contiguous and there is both (1) a plurality of inflatable chambers with fluid communication and (2) a plurality of inflatable chambers with no fluid communication.

While FIGS. 16*d* and 16*e* illustrate two methods for termination of fluid communication between inflatable chambers after inflation, other methods may be used and fit within the scope of this invention.

Figure 16F:
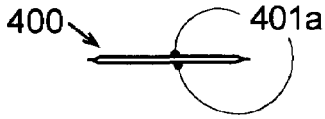

FIG. 16*f* shows a cross section of FIG. 16*b* where inflatable chambers 400 are comprised of two outer layers 401*a* of film.

Figure 16G:
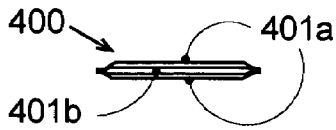

FIG. 16*g* shows a cross section of FIG. 16*b* where inflatable chambers 400 are comprised of two outer layers 401*a* of film and two inner layers 401*b* of film.

Figure 16H:
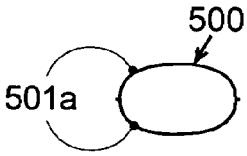

FIG. 16*h* shows a cross section of FIG. 16*c*, 16*d*, or 16*e* where inflated chambers 500 are comprised of two outer layers 501*a* of film.

Figure 16I:
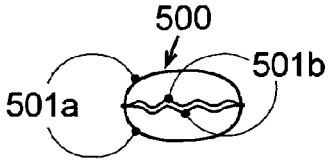

FIG. 16*i* shows a cross section of film in FIG. 16*c*, 16*d* or 16*e* when there are two outer layers of film 501*a* and two inner layers of film 501*b* involved. The air chambers between the top two layers of film and the air chambers between the bottom two layers of film are inflated with approximately equal pressure.

Figure 16J:
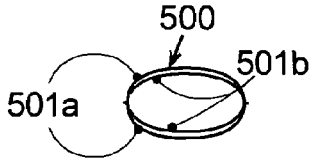

FIG. 16*j* shows a cross section of film in FIG. 16*c*, 16*d*, or 16*e* when there are two outer layers of film 501*a* and two inner layers of film 501*b* involved and the air chambers between the middle two layers of film are inflated.

While FIG. 16 illustrates the continuous balloon structure with two and with four layers of film, there might be any number of layers of two or more. While FIG.16 illustrates some combinations of inflation between layers, there might be any combination of inflation between layers.

Referring now to FIG. 17, it shows a continuous balloon structure and its formation according to an alternate preferred embodiment of the present invention.

Figure 17A:
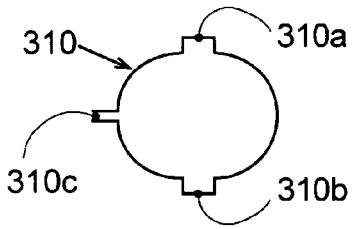
FIG. 17*a*-17*h* shows a continuous balloon structure and its formation according to an alternate preferred embodiment of the present invention.

FIG. 17*a* shows the die configuration 310 with appendages 310*a* and 310*b* at opposite ends. Also shown is an extension with an opening 310*c*. The die configuration shown is basically circular, but might be any shape, including shapes which include smaller inflatable and/or non inflatable chambers within its borders.

FIG. 17*a*1 shows the area encompassed by a line that traces the outermost edges of a single set of seals made by die configuration 310 and that closes any gap/s in that trace by joining adjacent ends of that trace with straight line/s.

Figure 17B:
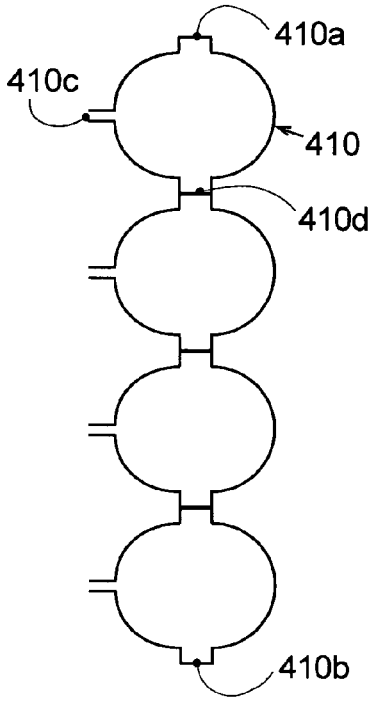

FIG. 17*b* shows continuous balloon structure 410 which is the result of four applications of die configuration 310 on a plurality of layers of film. The die applications touch or overlap slightly at contacts 410*d* thereby creating a connected series of inflatable chambers between ends 410*a* and 410*b* with no fluid communication between chambers in the linear series. While, the results of four die applications are illustrated, there might be any plurality of such die applications.

FIG. 17*b*1 shows the area encompassed by a line that traces the outermost reaches of all sets of seals from die impressions made with die configuration 310 that comprise continuous balloon structure 410 and that closes any gap/s in that trace by joining adjacent ends of that trace with straight line/s.

Figure 17C:
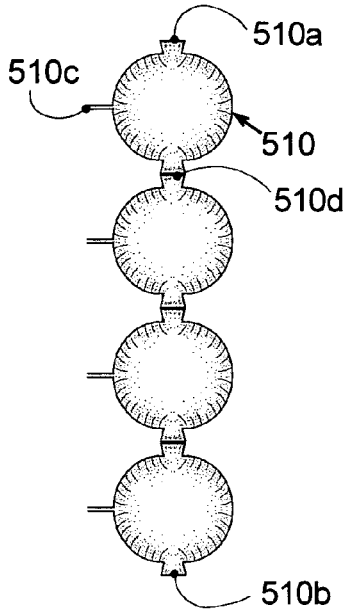
Figure 17C:
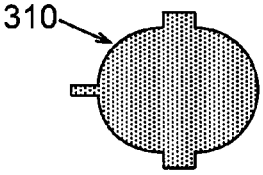

FIG. 17*c* shows the effect of inflation. The inflated chambers 510 are connected at contacts 510*d* between ends 510*a* and 510*b*. The chambers are inflated individually through openings 510*c*. In order to retain the inflated state these openings 510*c* would be closed after inflation.

Figure 17D:
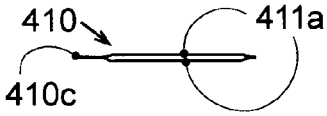
Figure 17D:
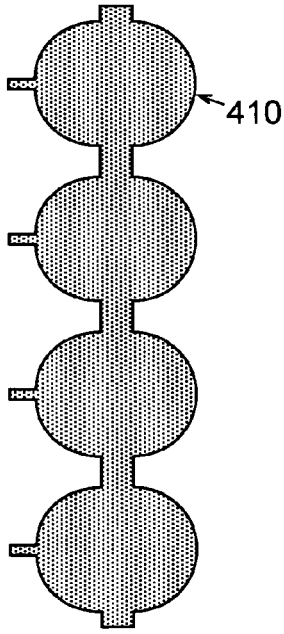

FIG. 17*d* shows a cross section of FIG. 17*b* where inflatable chambers 410 are comprised of two outer layers 411a of film. There are openings in the chambers at 410*c*.

Figure 17E:
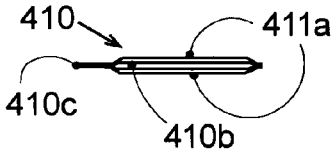

FIG. 17*e* shows a cross section of FIG. 17*b* where inflatable chambers 410 are comprised of two outer layers 411*a* of film and two inner layers 411*b* of film. Chamber openings occur at 410*c*.

Figure 17G:
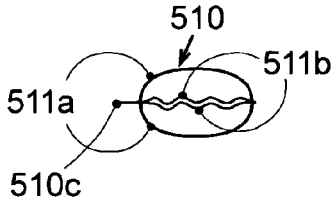
Figure 17F:
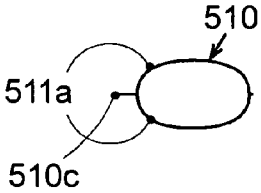

FIG. 17*f* shows a cross section of FIG. 17*c*, 17*d*, or 17*e* where inflated chambers 500 are comprised of two outer layers 511*a* of film. The chambers were inflated through openings at 510*c*. These openings would be closed after inflation in order to retain the inflated state.

FIG. 17*g* shows a cross section of film in FIG. 17*c*, 17*d* or 17*e* when there are two outer layers of film 511*a* and two inner layers of film 511*b* involved. The air chambers between the top two layers of film and the air chambers between the bottom two layers of film are inflated with approximately equal pressure.

Figure 17H:
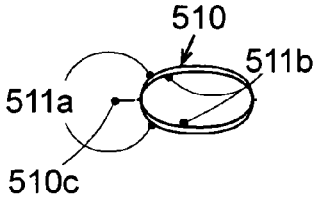

FIG. 17*h* shows a cross section of film in FIG. 17*c*, 17*d*, or 17*e* when there are two outer layers of film 511*a* and two inner layers of film 511*b* involved and the air chambers between the middle two layers of film are inflated.

While FIG. 17 illustrates the continuous balloon structure with two and with four layers of film, there might be any number of layers of two or more.

While FIG. 17 illustrates some combinations of inflation between layers, there might be any combination of inflation between layers.

FIG. 17 illustrates a continuous balloon structure with a beginning 410*a* and an end 410*b* and does not have fluid communication between inflatable chambers. The beginning and the end are not contiguous.

Referring now to FIG. 18, it shows a continuous balloon structure and its formation according to a preferred embodiment of the present invention.

Figure 18A:
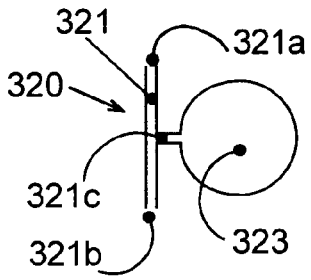
FIG. 18*a*-18*c* shows a continuous balloon structure and its formation according to an alternate preferred embodiment of the present invention.

FIG. 18*a* shows the die configuration 320 incorporating a manifold 321 with openings 321*a* and 321*b* at opposite ends. The manifold opens into the circular chamber 323 at 321*c*. The connection 321*c* is shown here as a short conduit, but could be simply an opening contact of practically no length or could be an elaborate shape of larger scale. The chamber shown is basically circular, but might be any shape, including shapes which include smaller inflatable chambers within its borders.

Figure 18B:
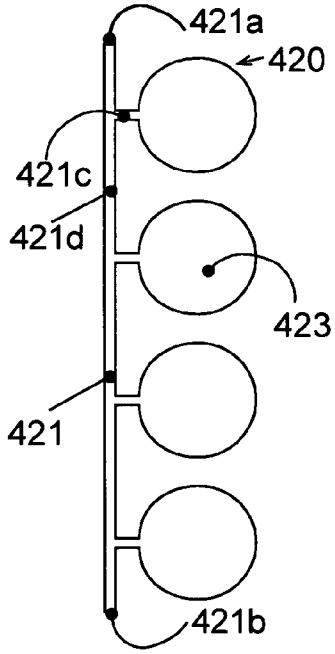

FIG. 18*b* shows the result 420 of four applications of this die on a plurality of layers of film. The die applications touch or overlap slightly at the openings 421*d* thereby creating a connected series of inflatable chambers between open ends 421*a* and 421*b* with fluid communication between chambers 423 in the series through connections 421*c* and manifold 421. While, the results of four die applications are illustrated, there might be any plurality of such die applications. Four connected chambers 423 are shown but there might be any quantity of two or more such connected, inflatable chambers.

Figure 18C:
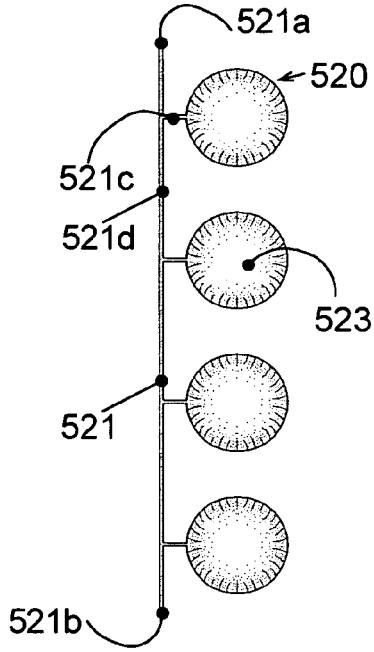

FIG. 18*c* shows the effect of inflation. The resulting, inflated continuous balloon structure is generally indicated by reference numeral 520. The inflated chambers 523 are a connected series between ends 521*a* and 521*b* with fluid communication between chambers 523 through connections 521*c* and manifold 521. The ends 521*a* and 521*b* would be closed to retain the inflated state.

Figure 19A:
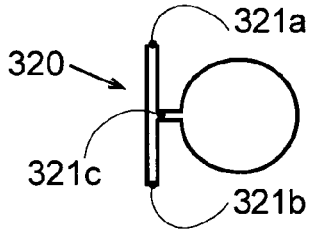
FIG. 19*a*-19*c* shows a continuous balloon structure and its formation according to an alternate preferred embodiment of the present invention.
Figure 19B:
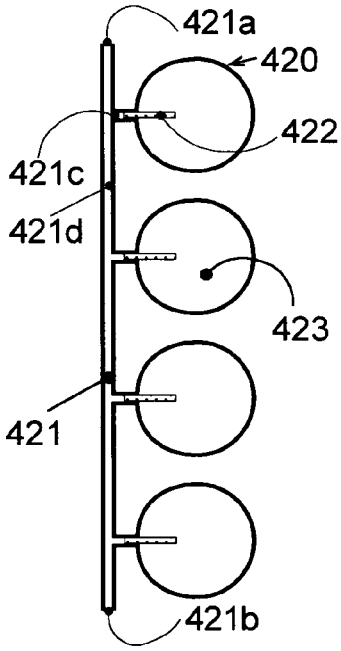
Figure 19C:
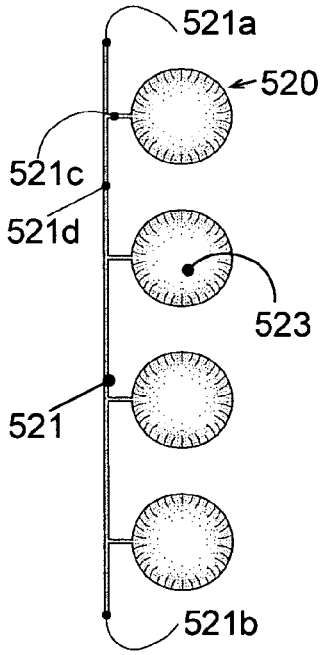

Referring now to FIG. 19, it shows a continuous balloon structure and its formation according to an alternate preferred embodiment of the present invention. The features of FIG. 19 are the same as FIG. 18 except for the addition of self-sealing valves 422 at the connection 421*c* between the manifold 421 and chambers 423. The valves allow all the chambers 423 to be inflated at once but prevent exit of fluids from each chamber. This protects one chamber from deflation simply because of deflation in connected chamber/s.

Referring now to FIG. 20, it shows a continuous balloon structure and its formation according to a preferred embodiment of the present invention. FIG. 20*a* shows the die configuration 330 with appendages 330*a* and 330*b* at opposite ends. The die configuration shown is basically circular, but might be any shape, including shapes which include smaller inflatable and/or non inflatable chambers within its borders.

Figure 20A:
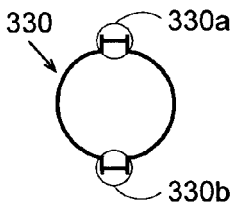
FIG. 20*a*-20*d* shows a continuous balloon structure and its formation according to an alternate preferred embodiment of the present invention.
Figure 20B:
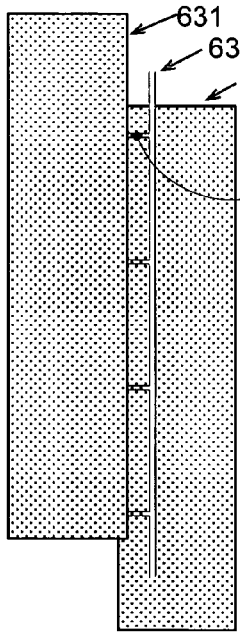

FIG. 20*b* shows two layers of film 631 and 633 with a manifold 632 between them.

Figure 20C:
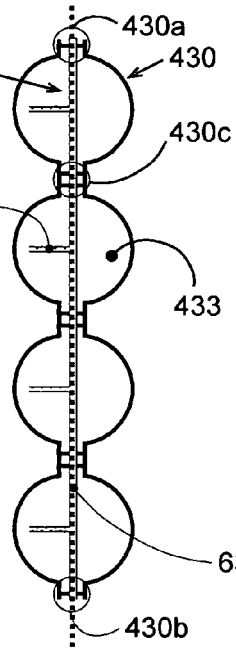

FIG. 20*c* shows the result of four applications of die 330 on the two of layers of 631 and 633 with a manifold 632 between them. The die applications touch or overlap slightly at the appendages 430*c* thereby creating a connected series of inflatable chambers 433 between ends 430*a* and 430*b*. These chambers would not be inflatable except for the manifold 632 placed between layers and sealed in place there. The outside surface of the manifold is sealed to the surrounding layers of film that form the chambers at locations 430*c*. The inner surfaces of the manifold are treated to prevent sealing when the die is applied. This figure also illustrates the placement of self-sealing valves 634 at openings of the manifold within each inflatable chamber. The use of the valves allows all chambers to be inflated at once through the manifold but prevents exit of the inflation fluid from the chambers. This eliminates the risk of one inflated chamber deflating simply because of fluid loss in a connected chamber. While this FIG. shows only two layers of film and a single manifold, there could be any number of two or more layers and any number of manifolds encased among the layers. While, the results of four die applications are illustrated, there might be any plurality of such die applications. Four connected chambers 433 are shown but there might be any quantity of two or more such connected, inflatable chambers.

FIG. 20*c* also shows an object 635 within the manifold 632. In the arrangement show here, there is a clear passageway for objects through the manifold without damaging the seal of the chambers. Such an object may have decorative, informative, structural, or other value to the finished display. For instance, strings of lights might be passed through the manifold to make the entire display glow from inside. Semi-rigid materials might be placed within the manifold to give structural support or bent to give sculptural form to the display. Water hose might be passed through the manifold to provide a hidden source of water for a fountain effect. Strips of text might be placed inside to present greetings or information when viewed through clear or translucent forms of the display. Other inflatable objects might be incorporated as well. While a single manifold passing through the center of all chambers is shown here, there could be any number of such manifolds in many different shapes and passing generally in a variety of directions and containing different objects. It is also possible that similar conduits through continuous balloon structures could be provided that did not serve for inflation, but only other uses as suggested above.

Figure 20D:
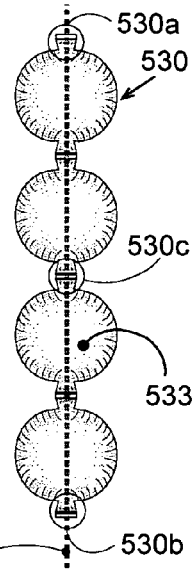

FIG. 20*d* shows the continuous balloon structure 530 with four chambers inflated and the manifold and self-sealing valves hidden inside. The object 635 is just visible protruding from ends 530*a* and 530*b* of the continuous balloon structure. Inflated chambers 533 are joined at connections 530*c*.

Figure 20E:
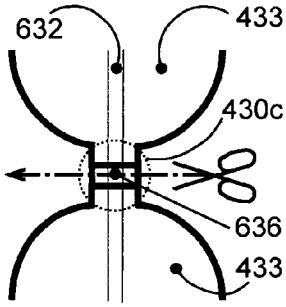
FIG. 20*e* shows a "safe cut line" 636 between connected inflatable chambers 433.

FIG. 20*e* shows a "safe cut line" 636 between connected inflatable chambers 433. This safe cut line is located at the joint 430*c* where adjacent inflatable chambers 433 meet. This location may be used to cut and separate inflatable chambers 433 along with sections of manifold 632 without losing the ability to inflate or to maintain inflation of adjacent inflatable chambers 433. If separated before inflation then each chamber may be inflated separately. If separated after inflation then each chamber will maintain it inflated status independently.

Referring now to FIG. 21, it shows a continuous balloon structure and its formation according to a preferred embodiment of the present invention.

Figure 21A:
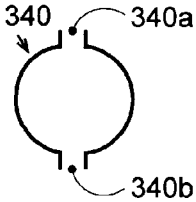
FIG. 21*a*-21*d* shows a continuous balloon structure and its formation according to an alternate preferred embodiment of the present invention.

FIG. 21*a* shows the die configuration 340 with openings 340*a* and 340*b* at opposite ends. The die configuration shown is basically circular, but might be any shape, including shapes which include smaller inflatable chambers within its borders, as long as at least two openings can be matched during multiple applications of the die.

Figure 21B:
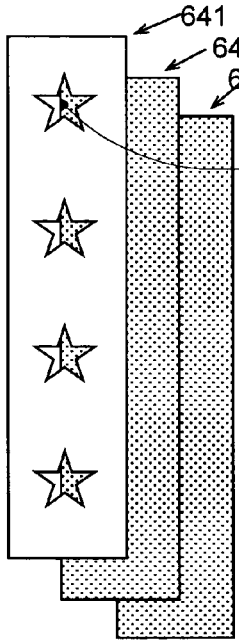

FIG. 21*b* shows three layers of film 641,642, and 643 with star shaped cut outs 644 in the top layer 641. The star shape is shown as a sample only. The cut out might be any shape desired. The three layers of film are also representative only. Any plurality of three or more layers of film could serve for this example.

Figure 21C:
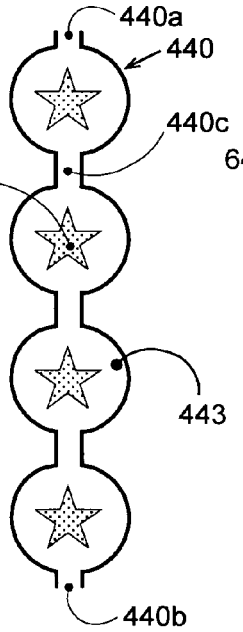

FIG. 21*c* shows the result of four applications of die 340 on the three layers 641, 642, and 643 of film. The die applications touch or overlap slightly at the connections 440*c* thereby creating a connected series 440 of inflatable chambers 443 with fluid communication between ends 440*a* and 440*b*. The inflatable chambers are formed between layers 642 and 643. The star shaped cut outs 644 in layer 641 prevent layers 641 and 642 from forming chambers that could be effectively inflated. While not illustrated here, it is worth noting that the cut outs would allow objects to be inserted between layers 641 and 642. While, the results of four die applications are illustrated, there might be any plurality of such die applications. Four connected chambers 443 are shown but there might be any quantity of two or more such connected, inflatable chambers.

Figure 21D:
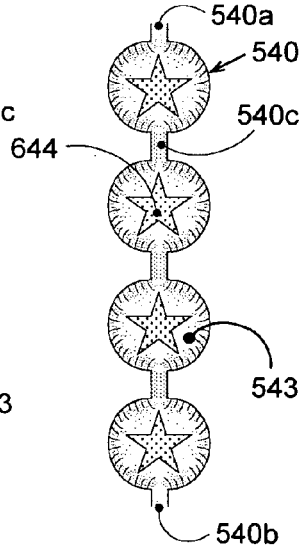

FIG. 21*d* shows the connected series 540 of four chambers 543 inflated with fluid communication through connections 540*c* between ends 540*a* and 540*b*. The ends would be closed after inflation to maintain the inflated state. The star cut outs 644 in layer 641 make a decorative display on layer 642.

Referring now to FIG. 22, it shows a continuous balloon structure and its formation according to a preferred embodiment of the present invention.

Figure 22A:
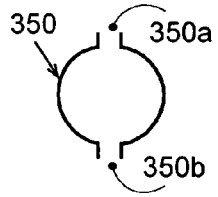
FIG. 22*a*-22*f* shows a continuous balloon structure and its formation according to an alternate preferred embodiment of the present invention.

FIG. 22*a* shows the die configuration 350 with openings 350*a* and 350*b* at opposite ends. The die configuration shown is basically circular, but might be any shape, including shapes which include smaller inflatable chambers within its borders, as long as at least two openings can be matched during multiple applications of the die.

Figure 22B:
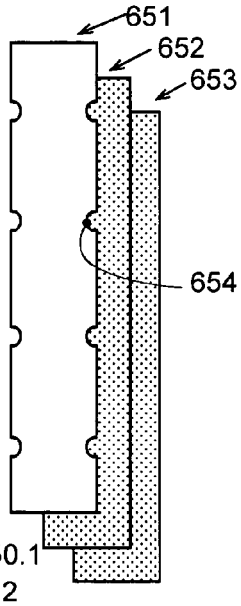

FIG. 22*b* shows three layers of film 651, 652, and 653 with semicircle shaped cut outs 654 in the top layer 651 at the edges. The semicircle shape is shown as a sample only. The cut out might be any shape desired. The three layers of film are also representative only. Any plurality of three or more layers of film could serve for this example.

Figure 22C:
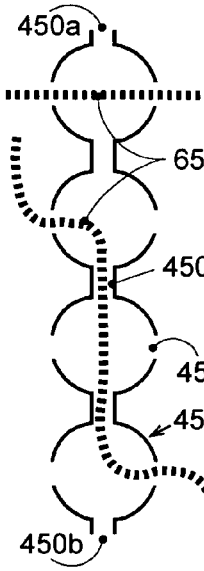

FIG. 22*c* shows the result of four applications of die 350 on the top two layers 651 and 652 of film. The die applications touch or overlap slightly at the connections 450*c* thereby creating a connected series of non-inflatable chambers 450.1 with fluid communication between ends 450*a* and 450*b*. The semi-circle shaped cut outs 654 in layer 651 leave openings 450*d* in the chambers 450.1 and thereby prevent layers 651 and 652 from forming chambers that could be effectively inflated. The cut outs do allow objects to be inserted between layers 651 and 652 through openings 450*d*. Sample objects 655 and sample paths are shown, but actual objects and paths may vary greatly from the samples shown. While, the results of four die applications are illustrated, there might be any plurality of such die applications. Four connected chambers 450.1 are shown but there might be any quantity of two or more such connected chambers.

Figure 22D:
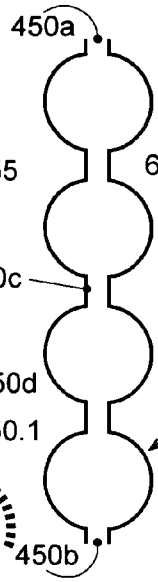

FIG. 22*d* shows the result of four applications of die 350 on the bottom two layers 652 and 653 of film. The die applications touch or overlap slightly at the connections 450*c* thereby creating a connected series of inflatable chambers 450.2 with fluid communication between ends 450*a* and 450*b*.

Figure 22E:
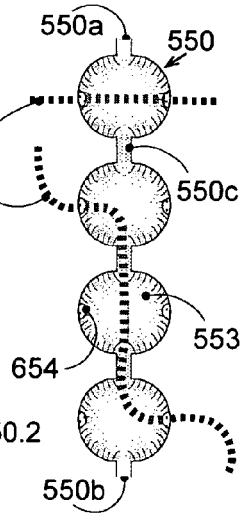

FIG. 22*e* shows the continuous balloon structure 550 with its four sections 553 after inflation of inflatable chambers. Fluid communication between inflated chambers exists through connections 550*c* between ends 550*a* and 550*b*. The ends would be closed after inflation to maintain the inflated state. Also shown are the cutouts 654 and the sample paths of sample objects 655 between the top two layers 651 and 652 of film. Such objects may have decorative, informative, structural, or other value to the finished display. For instance, strings of lights might be passed between layers to make the entire display glow. Semi-rigid materials might be placed between the layers to give structural support or bent to give sculptural form to the display. Water hose might be passed between the layers to provide a hidden source of water for a fountain effect. Strips of text might be placed inside to present greetings or information when viewed through clear or translucent forms of the display. Other inflatable objects might be incorporated as well.

Figure 22F:
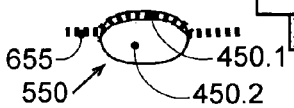

FIG. 22*f* shows a cross section of section 550 with object 655 squeezed in non-inflated chamber 450.1 by the pressure created when inflatable chamber 450.2 is inflated.

Referring now to FIG. 23, it shows a continuous balloon structure and its formation according to a preferred embodiment of the present invention.

Figure 23A:
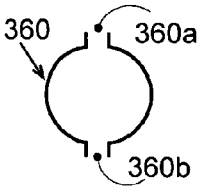
FIG. 23*a*-23*g* shows a continuous balloon structure and its formation according to an alternate preferred embodiment of the present invention.

FIG. 23*a* shows the die configuration 360 with openings 360*a* and 360*b* at opposite ends. The die configuration shown is basically circular, but might be any shape, including shapes which include smaller inflatable chambers within its borders, as long as at least two openings can be matched during multiple applications of the die.

Figure 23B:
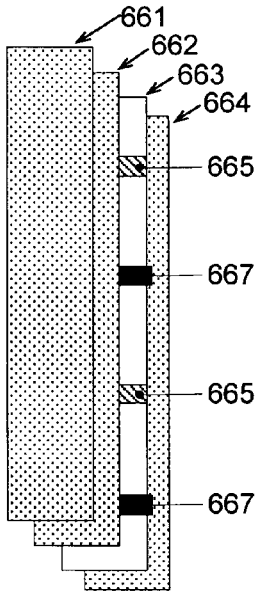

FIG. 23*b* shows four layers of film 661, 662, 663 and 664. The third layer 663 has been treated in strips 665 on the topside of the film to resist being sealed to the second layer of film 662. There are also inserts 667 of seal resistant material placed between layers 662 and 663 to prevent seals between layers 662 and 663 in those areas. The inserts have the disadvantage of adding another element into the processing. The inserts have the advantage of being easily removable later so that the unsealed area might be sealed after some further processing by the manufacturer or end user. For instance, the opening might be used to insert some decorative, structural or informative object between layers and then sealed to prevent its removal. The four layers of film are representative of a plurality of three or more layers. With at least three layers we may show conditions as illustrated in FIG. 22 wherein openings exist between layers otherwise sealed together where the die is applied. In FIG. 22 the break in the seal of the die application occurs because film is cut away. In FIG. 23 the break occurs because sections of film are resistant to sealing. With at least four layers of film we may show the same effect with the added condition that the opening between layers is also between inflatable chambers.

Figure 23C:
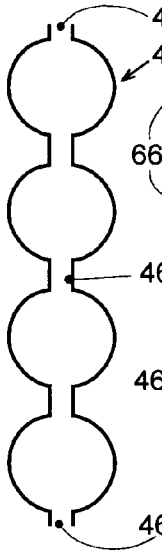

FIG. 23*c* shows the result of four applications of die 360 on the top two layers 661 and 662 of film. The die applications touch or overlap slightly at the connections 460*c* thereby creating a connected series of inflatable chambers 460.1 with fluid communication between ends 460*a* and 460*b*.

Figure 23D:
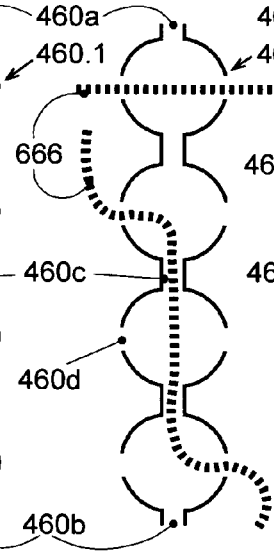

FIG. 23*d* shows the result of four applications of die 360 on the middle two layers 662 and 663 of film. The die applications touch or overlap slightly at the connections 460*c* thereby creating a connected series of non-inflatable chambers 460.2 with fluid communication between ends 460*a* and 460*b*. The seal resistant strips 665 prevent layers 662 and 663 from forming chambers that could be effectively inflated. The breaks in the seal 460*d* where applications of die 360 cross 665 allow objects to be inserted between layers 662 and 663. Sample objects 666 and sample paths are shown, but actual objects and paths may vary greatly from the samples shown. While, the results of four die applications are illustrated, there might be any plurality of such die applications. Four connected chambers 460.2 are shown but there might be any quantity of two or more such connected chambers.

Figure 23E:
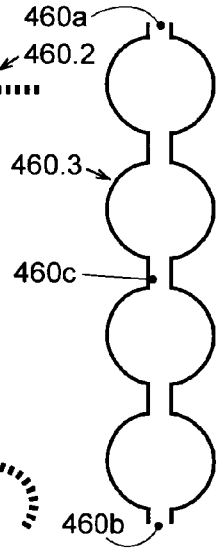

FIG. 23*e* shows the result of four applications of die 360 on the bottom two layers 663 and 664 of film. The die applications touch or overlap slightly at the connections 460*c* thereby creating a connected series of inflatable chambers 460.3 with fluid communication between ends 460*a* and 460*b*.

Figure 23F:
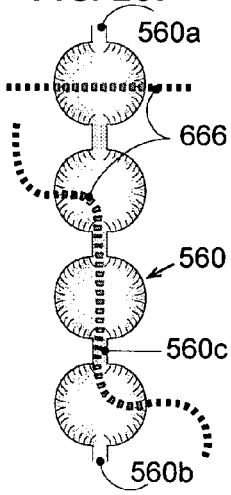

FIG. 23*f* shows the continuous balloon structure 560 with its four sections after inflation of inflatable chambers and removal of inserts 667. Fluid communication between inflated chambers exists through connections 560*c* between ends 560*a* and 560*b*. The ends would be closed after inflation to maintain the inflated state. Also shown are the sample paths of sample objects 666 between the middle two layers 662 and 663 of film. Such objects may have decorative, informative, structural, or other value to the finished display. For instance, strings of lights might be passed between layers to make the entire display glow. Semi-rigid materials might be placed between the layers to give structural support or bent to give sculptural form to the display. Water hose might be passed between the layers to provide a hidden source of water for a fountain effect. Strips of text might be placed inside to present greetings or information when viewed through clear or translucent forms of the display. Other inflatable objects including other continuous balloon structures might be incorporated as well.

Figure 23G:
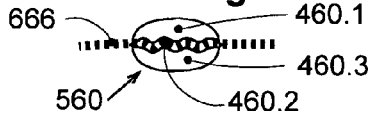

FIG. 23*g* shows a cross section of 560 with object 666 squeezed in non-inflated chamber 460.2 by the pressure created when inflatable chambers 460.1 and 460.3 are inflated with approximately equal pressure.

Referring now to FIG. 24, it shows a continuous balloon structure and its formation according to a preferred embodiment of the present invention.

Figure 24A:
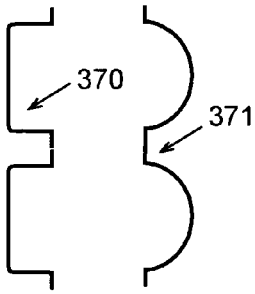
FIG. 24*a*-24*e* shows a continuous balloon structure and its formation according to an alternate preferred embodiment of the present invention.
Figure 24A:
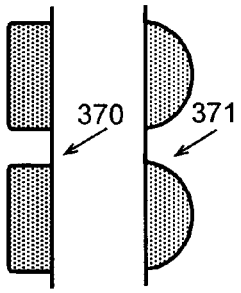

FIG. 24*a* shows two die configurations 370 and 371.

Figure 24B:
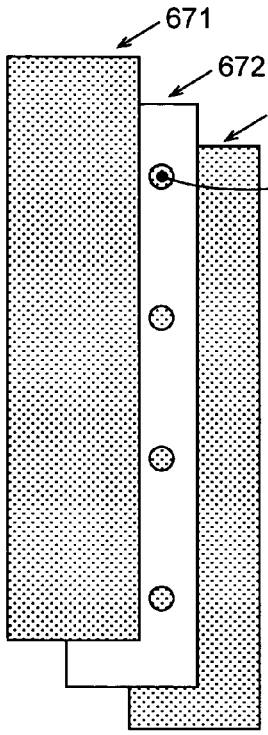

FIG. 24*a*1 shows the area encompassed by a line that traces the outermost edges of a single set of seals made by die configuration 370 and that closes any gap/s in that trace by joining adjacent ends of that trace with straight line/s. It also shows the area encompassed by a line that traces the outermost edges of a single set of seals made by die configuration 371 and that closes any gap/s in that trace by joining adjacent ends of that trace with straight line/s FIG. 24*b* shows three layers of film 671, 672, and 673. The middle layer has circular cut outs 674. While four circular shaped cut outs are shown they might be any shape desired and be in greater or smaller quantities than illustrated. While three layers of film are shown there might be any plurality of three or more layers and there might be any number of one or more inner layers with cut outs.

Figure 24C:
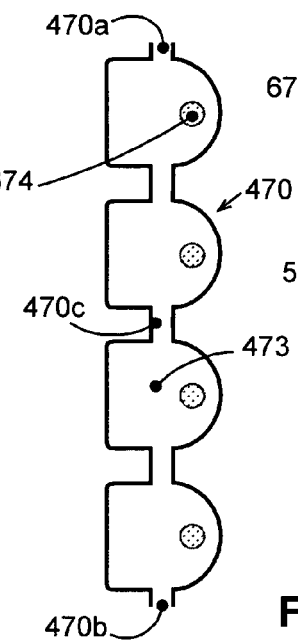

FIG. 24*c* shows the effect of two die applications by each of the two die configurations on the three layers of film. The lines 470 represent seals between adjacent layers of film resulting from the die applications. These die applications are made in such a way that the die applications touch or overlap slightly at contacts 470*c* thereby creating a connected series of inflatable chambers 473 with fluid communication between ends 470*a* and 470*b*. The placements of cut outs 674 are also illustrated. While two applications of each die configuration are shown, there might be any plurality of die applications by either or both die configurations as long as they result in a connected series of inflatable chambers.

FIG. 24*c*1 shows the area encompassed by a line that traces the outermost reaches of all sets of seals from die impressions 370 and 371 that comprise continuous balloon structure 470 and that closes any gap/s in that trace by joining adjacent ends of that trace with straight line/s.

Figure 24D:
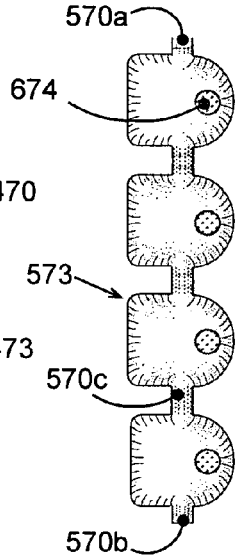

FIG. 24*d* shows the continuous balloon structure after inflation of sections 473, which are now labeled as 573. Fluid communication between chambers is through connections 570*c* between ends 570*a* and 570*b*. Placements of cut outs 674 are also illustrated.

Figure 24E:
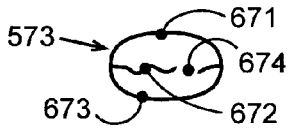
Figure 24E:
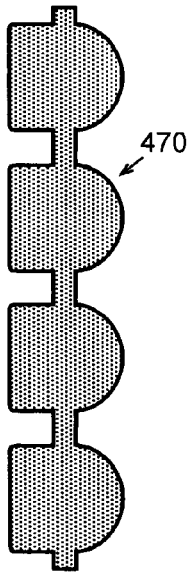

FIG. 24*e* shows a cross section of sections 573 with layers 671, 672, and 673 identified along with cut out 674. This view shows clearly the fluid communication between adjacent chambers separated by at least one layer with at least one aperture 674.

Figure 24F:
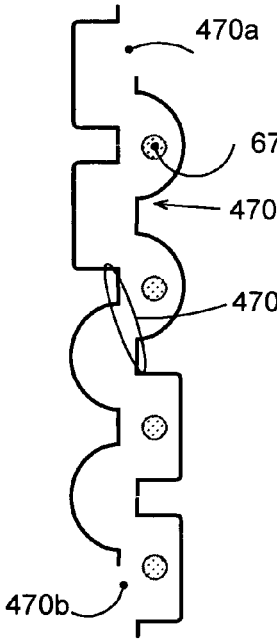
FIG. 24*f* shows an alternate seal pattern resulting from two applications of each of the two dies.
Figure 24G:
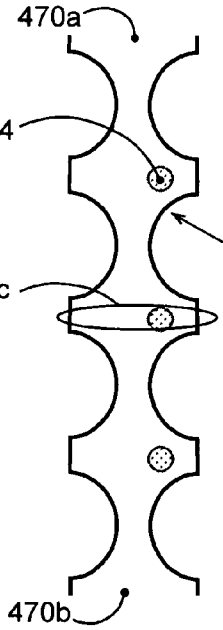
FIG. 24*g* shows an alternate seal pattern resulting from four applications of the first of the two dies.
Figure 24H:
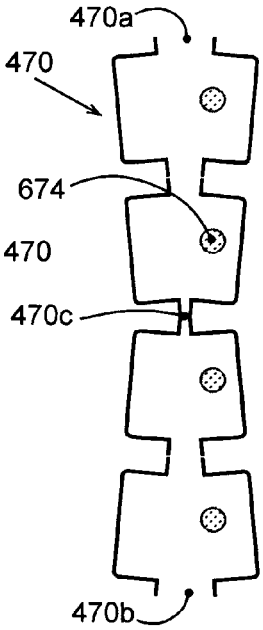
FIG. 24*h* shows an alternate seal pattern resulting from four applications of the second of the two dies.

FIGS. 24*f*, 24*g* and 24*h* show the result of alternate combinations and rotations of die applications of die configurations 370 and 371 to layers 671, 672, and 673. These die applications are made in such a way that the die applications touch or overlap slightly at contacts 470*c* thereby creating a connected series of inflatable chambers 470 with fluid communication between ends 470*a* and 470*b*. The placements of cut outs 674 are also illustrated. These are examples only. There may be many die configurations used in many combinations of sequence and positioning to create an enormous variety of continuous balloon structures. The area defined by all seals is the area circumscribed by lines 470 and imaginary straight lines across openings 470*a* and 470*b*.

Referring now to FIG. 25, it shows a continuous balloon structure with fluid communication between/among connected inflatable chambers and its formation according to a preferred embodiment of the present invention.

Figure 25A:
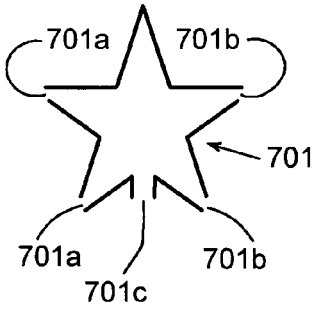
FIG. 25*a*-25*c* shows a continuous balloon structure and its formation according to an alternate preferred embodiment of the present invention.
Figure 25A:
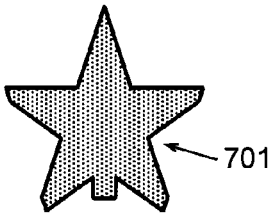

FIG. 25*a* shows the die configuration 701 with openings 701*a* and 701*b* on opposite sides and an opening on the bottom 701*c*. The die configuration shown is basically a five pointed star, but might be any shape, including shapes which include smaller inflatable chambers within its borders, as long as adjacent die applications can be matched for fluid communication.

FIG. 25*a*1 shows the area encompassed by a line that traces the outermost edges of a single set of seals made by die configuration 701 and that closes any gap/s in that trace by joining adjacent ends of that trace with straight line/s.

Figure 25B:
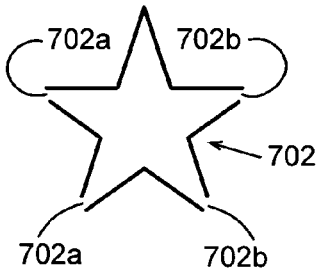
Figure 25B:
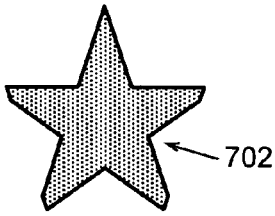

FIG. 25*b* shows the die configuration 702 with openings 702*a* and 702*b* on opposite sides. The die configuration shown is basically a five pointed star, but might be any shape, including shapes which include smaller inflatable chambers within its borders, as long as adjacent die applications can be matched for fluid communication.

FIG. 25*b*1 shows the area encompassed by a line that traces the outermost edges of a single set of seals made by die configuration 702 and that closes any gap/s in that trace by joining adjacent ends of that trace with straight line/s.

Figure 25C:
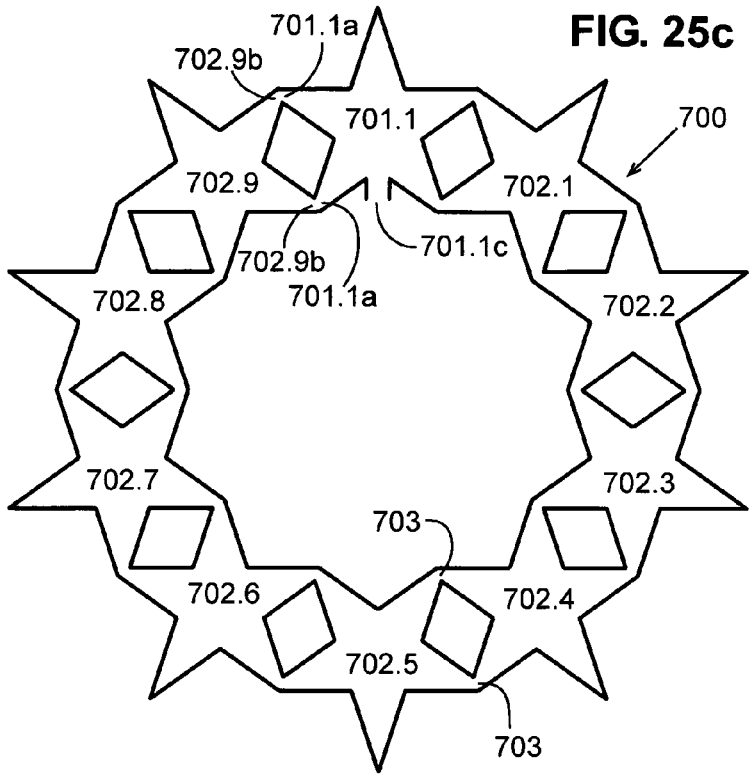
Figure 25C:
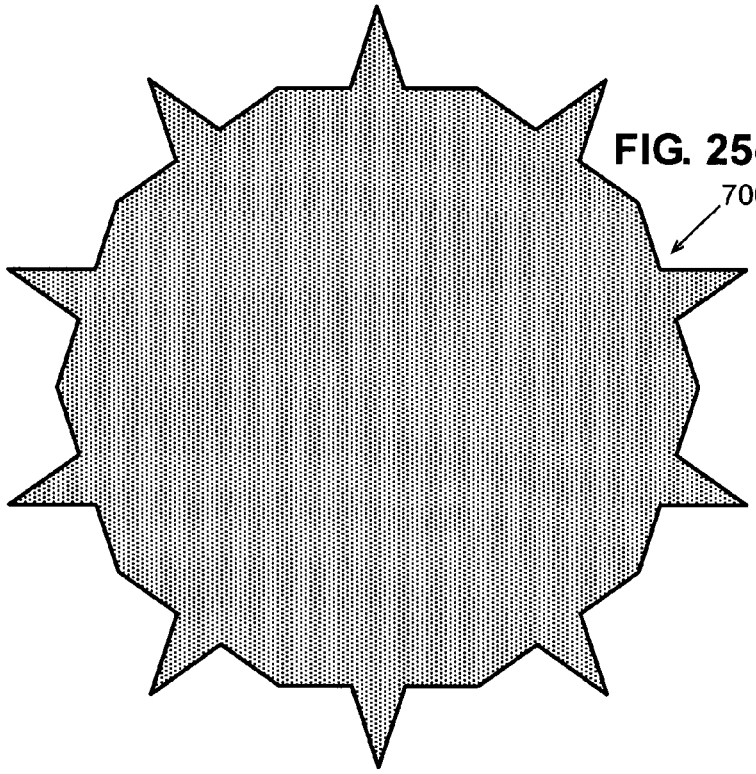

FIG. 25*c* shows continuous balloon structure 700 which is the result of one application of die configuration 701 labeled 701.1 and nine applications of die configuration 702 labeled as 702.1 through 702.9. Fluid communication between adjacent die applications is established by matching openings "a"

and "b" from adjacent die applications. The resulting connections are labeled as 703. The inflation opening for this balloon system is 701.1*c*.

The labeling system for continuous balloon structure 700 suggests a first end at openings 701.1*a* and a second end at openings 702.9*b*. The first end and the second end are contiguous. There is a plurality of inflatable chambers within continuous balloon structure 700 with fluid communication.

In practice, equipment that can rotate and apply die configuration 702 in the arrangement shown is not commonly used within the industry today. Such equipment would likely be capable of making the required die applications in any sequence desired and would not be limited to the numbered sequence shown.

FIG. 25*c*1 shows the area encompassed by a line that traces the outermost reaches of all sets of seals from die configurations 701 and 702 that comprise continuous balloon structure 700 and that closes any gap/s in that trace by joining adjacent ends of that trace with straight line/s.

Referring now to FIG.26; it shows a variety of configurations 801, 802, 803 and 804 of continuous balloon structures according to a preferred embodiment of the present invention that are generated from a single die configuration 800 with fluid communication between/among a plurality of connected inflatable chambers.

Figure 26A:
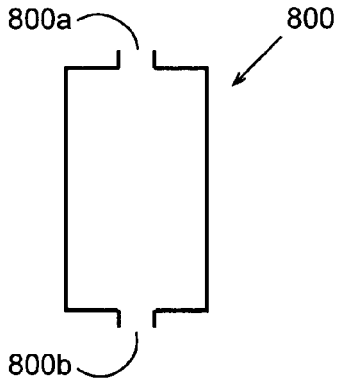
FIG. 26*a*-26*e* shows a continuous balloon structure and its formation according to an alternate preferred embodiment of the present invention.
Figure 26A:
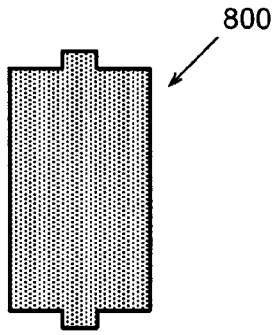
Figure 26A:
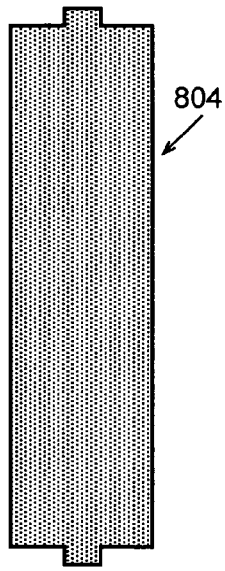

FIG. 26*a* shows the die configuration 800 with openings 800*a* and 800*b* on opposite ends. The die configuration shown is basically a rectangle, but might be any shape, including shapes which include smaller inflatable chambers within its borders, as long as adjacent die applications can be matched for fluid communication.

FIG. 26*a*1 shows the area encompassed by a line that traces the outermost edges of a single set of seals made by die configuration 800 and that closes any gap/s in that trace by joining adjacent ends of that trace with straight line/s.

Figure 26B:
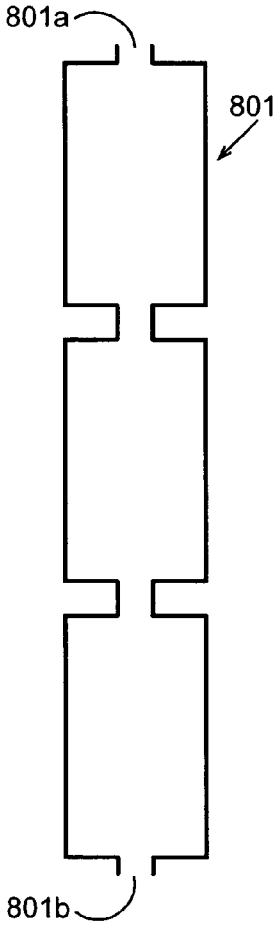

FIG. 26*b* shows continuous balloon structure 801 which results from three applications of die configuration 800. The openings of each die impression just touch or overlap slightly to establish fluid communication between adjacent inflatable chambers and continuous fluid communication from first end 801*a* to second end 801*b*.

Figure 26C:
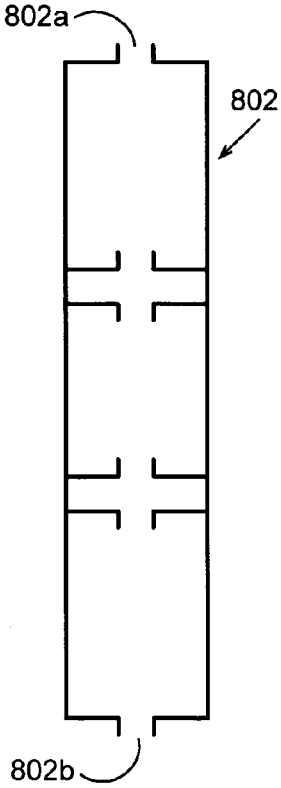

FIG. 26*c* shows the results of three applications of die configuration 800 where there is a significant overlap of die impressions in continuous balloon structure 802. This overlap creates more inflatable chambers over a shorter distance than in 26*b*. All inflatable chambers are in fluid communication. There is continuous fluid communication from first end 802*a* to second end 802*b*.

Figure 26D:
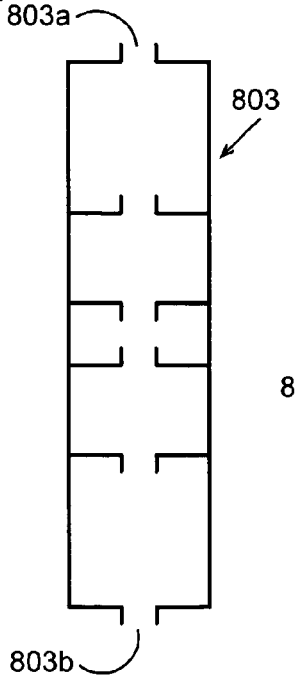

FIG. 26*d* shows the results of three applications of die configuration 800 where there is a great deal of overlap of die impressions in continuous balloon structure 803. This overlap creates the same number of inflatable chambers over a shorter distance than in 26*c*. All inflatable chambers are in fluid communication. There is continuous fluid communication from first end 803*a* to second end 803*b*.

Figure 26E:
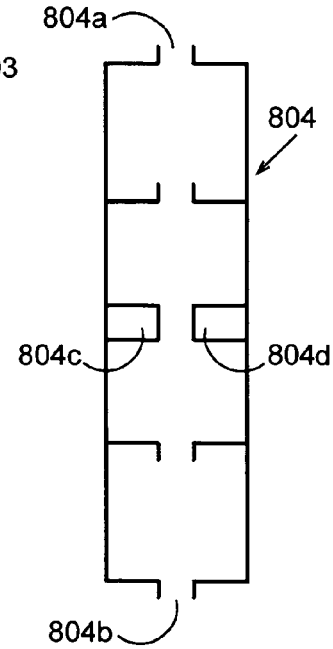

FIG. 26*e* shows the results of three applications of die configuration 800 where die impressions overlap by one half their length. This overlap creates the same number of chambers over a shorter distance than in 26*d*, but two chambers 804*c* and 804*d* are not in fluid communication with the others or with each other and have no outlet for inflation. There is continuous fluid communication from first end 804*a* to second end 804*b*.

FIG. 26*e*1 shows the area encompassed by a line that traces the outermost reaches of all sets of seals from die impression 800 that comprise continuous balloon structure 804 and that closes any gap/s in that trace by joining adjacent ends of that trace with straight line/s.

Referring now to FIG. 27, it shows a continuous balloon structure 920 with fluid communication between/among connected inflatable chambers and its formation according to a preferred embodiment of the present invention.

Figure 27A:
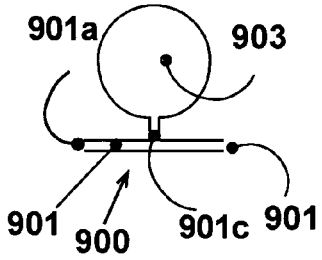
FIG. 27*a*-*d* shows a continuous balloon structure with heart shaped balloons inside inflatable chambers of the structure.

FIG. 27*a* shows the die configuration 900. The die configuration shown is basically a circle 903 with a manifold 901 having a first end opening 901*a* and a second end opening 901*b* and stem 901*c* connecting the manifold and the circular chamber 903. The die configuration, however, might be any shape, including shapes that include smaller inflatable chambers within its borders, as long as adjacent die applications can be matched for fluid communication and are appropriately sized and placed to encompass planned contents.

Figure 27C:
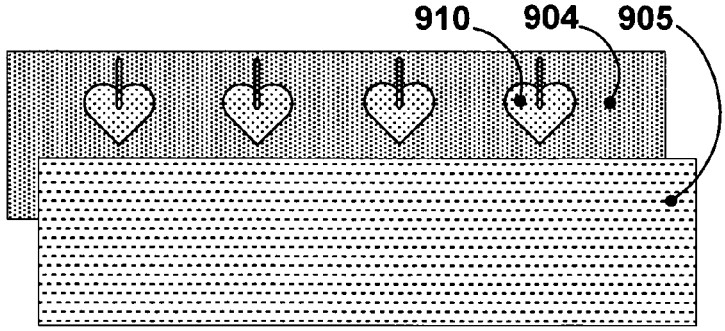
Figure 27B:
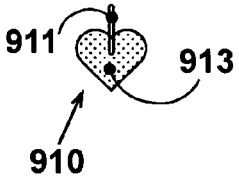

FIG. 27*b* shows a film balloon 910 with an inflation stem 911 and heart shaped inflatable chamber 913. The balloon, however, might be any desired shape as long as it is appropriately sized and placed to match the requirements of the planned surrounding structure. In order to prevent premature sealing of the balloon stems, the inside of the stems might be especially coated where the seal might otherwise occur from later die applications. Another protective alternative would be to use self-sealing valves inside the stems. They do not seal from die applications.

FIG. 27*c* shows two layers of film 904 and 905 with an array of four film balloons 910 between them.

Figure 27D:
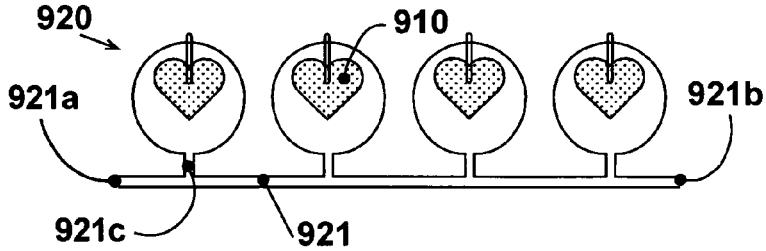

FIG. 27*d* shows continuous balloon structure 920 with film balloons 910 inside. This is the result of four, carefully registered applications of die configuration 900 on film layers 904 and 905 with film balloons 910 between them. There is fluid communication throughout continuous balloon structure 920 from first end opening 921*a* to second end opening 921*b*. Film balloons 910 may be inflated through their inflation stems.

Referring now to FIG. 28; it shows a continuous balloon structure 920 with fluid communication between/among connected inflatable chambers and its formation according to a preferred embodiment of the present invention.

Figure 28A:
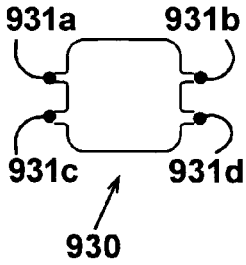
FIG. 28*a*-28*c* shows a continuous balloon structure and its formation.

FIG. 28*a* shows the die configuration 930 with openings 931*a* and 931*b* on opposite sides of the upper half and openings 931*b* and 931*d* on opposite sides of the lower half. The die configuration shown is basically a square with rounded corners, but might be any shape, including shapes that include smaller inflatable chambers within its borders, as long as adjacent die applications can be matched for fluid communication and are appropriately sized and placed to encompass planned contents.

Figure 28B:
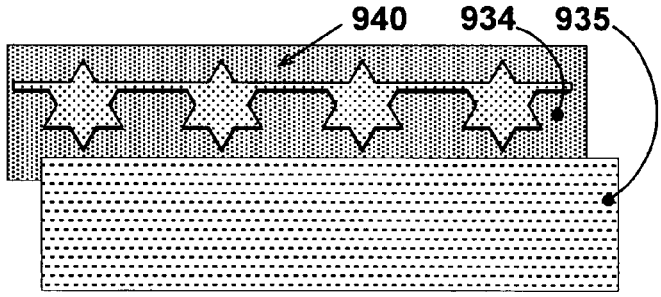

FIG. 28*b* shows two layers of film 934 and 935 with a continuous balloon structure 940 between them. The repeating six pointed star pattern of 940 is for illustration only. It might be any shape or pattern desired as long as it is appropriately sized and place to match with the planned outer structure.

Figure 28C:
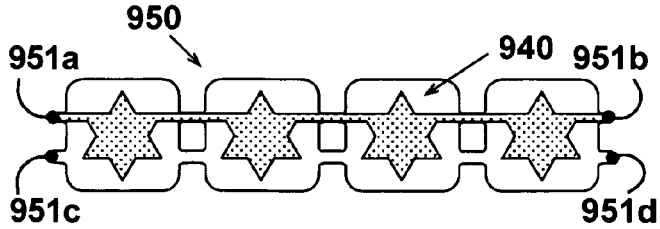

FIG. 28*c* shows continuous balloon structure 950 with continuous balloon structure 940 inside. This is the result of four, carefully registered applications of die configuration 930 on film layers 934 and 935 with continuous balloon structure 940 between them. There is fluid communication through 940 from first end opening 951*a* to second end opening 951*b*. There is fluid communication through the surrounding chambers of 950 from first end opening 951*c* to second end opening 951*d*.

Referring now to FIG. 29; it shows two continuous balloon structures 970.1 and 970.3 and their simultaneous formation according to a preferred embodiment of the present invention.

Figure 29A:
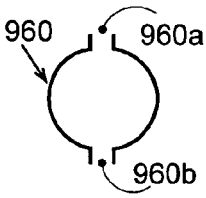
FIG. 29*a*-29*f* shows two continuous balloon structures and their simultaneous formation according to a preferred embodiment of the present invention.

FIG. 29*a* shows the die configuration 960 with openings 960*a* and 960*b* at opposite ends. The die configuration shown is basically circular, but might be any shape, including shapes which include smaller inflatable chambers within its borders, as long as at least two openings can be matched during multiple applications of the die.

Figure 29B:
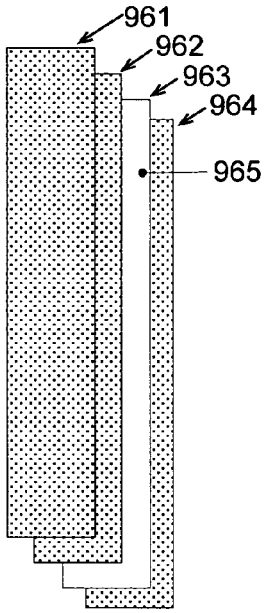

FIG. 29*b* shows four layers of film 961, 962, 963 and 964. The third layer 963 has been treated 965 on the topside of the film to resist being sealed to the second layer of film 962. The four layers of film are representative of a plurality of four or more layers.

Figure 29C:
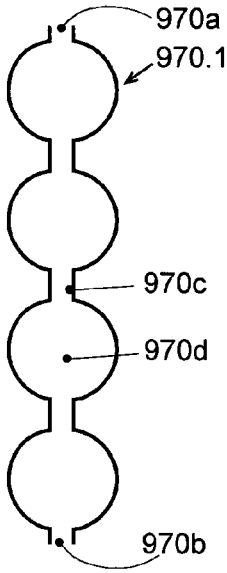

FIG. 29*c* shows the result of four applications of die 360 on the top two layers 961 and 962 of film. The die applications touch or overlap slightly at the connections 970*c* thereby creating a connected series of inflatable chambers 970.1 with fluid communication between ends 970*a* and 970*b*.

Figure 29D:
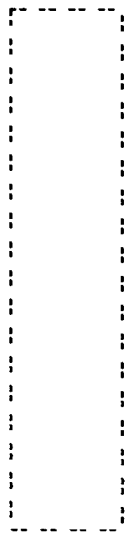

FIG. 29*d* shows (inside the dashed rectangle 970.2) the result of four applications of die 360 on the middle two layers 962 and 963 of film. There is no seal because of the seal resistant coating 965 on top of film layer 963.

Figure 29E:
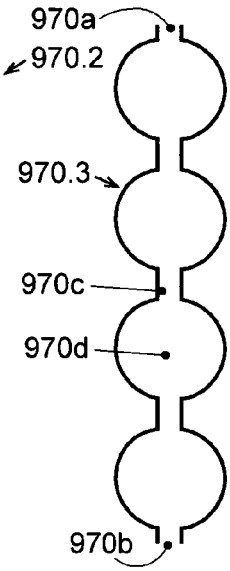

FIG. 29*e* shows the result of four applications of die 960 on the bottom two layers 963 and 964 of film. The die impression touch or overlap slightly at the connections 970*c* thereby creating a continuous balloon structure 970.3 from connected series of inflatable chambers 970*d* with fluid communication between ends 970*a* and 970*b*.

Figure 29F:
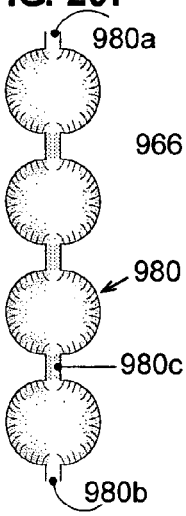

FIG. 29*f* shows the continuous balloon structure 980. This is an illustration of how continuous balloon structure 970.1 would appear after inflation. The same illustration applies equally as well to 970.3 after inflation. Fluid communication between inflated chambers exists through connections 980*c* between ends 980*a* and 980*b*. The ends would be closed after inflation to maintain the inflated state.

In such a process as described here, two continuous balloon structures 970.1 and 970.2 are simultaneously created. They are in physical contact during the process but are independent. It will be apparent to those of ordinary skill in the art of making and using balloons that additional layers of film may be added above the seal resistant coating or below the coating in order to simultaneously form continuous balloon structures of more complexity. It will be equally clear that other features and innovations disclosed earlier may be incorporated into the continuous balloon structures simultaneously created. It will also be apparent that by use of additional coatings and layers more than two continuous balloon structures may be simultaneously formed.

It will be apparent to those skilled in the art that many combinations, modifications and substitutions can be made to the preferred embodiments just described without departing from the spirit and scope of the invention as further defined in the appended claims.

What is claimed is:

1. A balloon display comprised of a plurality of connected, inflatable chambers formed from a plurality of layers of film that are joined together by a plurality of sets of seals wherein A. a set of seals is comprised of at least one seal made by one die application to said plurality of layers of film and;

B. the area encompassed by each and every first line is smaller than the area encompassed by a second line 1) wherein said first line traces the outermost edges of a single set of seals and closes any gap(s) in that trace by joining adjacent ends of that trace with straight line(s) and;

2) wherein said second line traces the outermost reaches of all sets of seals and closes any gap(s) in that trace by joining adjacent ends of that trace with straight line(s) and;

C. said inflatable chambers are connected by said film from which said inflatable chambers are formed and;

D. said balloon display further comprising at least one from the group consisting of 1) there is a first end and a second end to said sets of seals wherein said first end and said second end are not contiguous and;

2) there is fluid communication between/among a plurality of said inflatable chambers.

2. The balloon display as recited in claim 1 wherein at least one said layer of film is different in shape from another said layer of film.

3. The balloon display as recited in claim 1 wherein at least one area of surface on at least one layer of said film has different sealing characteristics from at least one area of surface on another layer of said plurality of layers of film.

4. The balloon display as recited in claim 1 wherein at least one self sealing valve is incorporated within a path of fluid communication leading into at least one said inflatable chamber wherein said valve is configured to allow fluids to pass into said at least one inflatable chamber but inhibit the release of said fluids from said at least one inflatable chamber.

5. The balloon display as recited in claim 1 wherein a connection between a plurality of said inflatable chambers incorporates at least one notch and said at least one notch is configured to facilitate bending said connection.

6. The balloon display as recited in claim 1 wherein a connection between a plurality of said inflatable chambers incorporates at least one smaller, bulbous chamber configured to neutralize angular deflection between larger, adjacent chambers when said chambers are inflated.

7. The balloon display as recited in claim 1 wherein a plurality of said inflatable chambers are not in fluid communication.

8. The balloon display as recited in claim 1 wherein a plurality of said inflatable chambers are in fluid communication.

9. The balloon display as recited in claim 8 wherein said plurality of layers of film are at least three layers of film and wherein there is at least one aperture in at least one inner layer of film that allows fluid communication between at least two adjacent chambers.

10. The balloon display as recited in claim 8 wherein a plurality of said inflatable chambers are connected by at least one manifold configured to allow fluid communication into a plurality of said chambers.

11. The balloon display as recited in claim 10 wherein said at least one manifold is located between outer layers of the film used to form said plurality of inflatable chambers.

12. The balloon display as recited in claim 1 wherein at least part of at least one object is positioned between two adjacent layers of said plurality of layers of film.

13. A method for creating a balloon display comprised of the following steps:

A. a first die application is made to a plurality of layers of film such that a plurality of said layers of film are joined by a first set of seals wherein said first set of seals is comprised of at least one seal and;

B. at least one additional die application is made to said plurality of layers of film such that a plurality of said layers of film are joined by at least one additional set of seals wherein each said additional set of seals is comprised of at least one seal and;

C. the combination of said first set of seals and said at least one additional set of seals form a plurality of connected, inflatable chambers wherein;

1) the area encompassed by each and every first line is smaller than the area encompassed by a second line;

a. wherein said first line traces the outermost edges of a single set of seals and closes any gap(s) in that trace by joining adjacent ends of that trace with straight line(s) and;

b. wherein said second line traces the outermost reaches of all sets of seals and closes any gap(s) in that trace by joining adjacent ends of that trace with straight line(s) and;

2) said inflatable chambers are connected by said film from which said inflatable chambers are formed and;

3) said balloon display further comprising at least one from the group consisting of a. there is a first end and a second end to said sets of seals wherein said first end and said second end are not contiguous and;

b. there is fluid communication between/among a plurality of said inflatable chambers.

14. The method as recited in claim 13 further comprising the step of inflating at least one of said plurality of inflatable chambers.

15. The method as recited in claim 13 wherein a plurality of inflatable chambers thus formed are not in fluid communication.

16. The method as recited in claim 13 wherein a plurality of inflatable chambers thus formed are in fluid communication.

17. The method as recited in claim 16 further comprising the steps of

A. inflating a plurality of said inflatable chambers that are inn fluid communication and;

B. subsequently terminating fluid communication between/among a plurality of said chambers that are inflated and in fluid communication.

18. The method as recited in claim 13 further comprising the step of inserting at least part of at least one object between at least two adjacent layers of said plurality of layers of film.

* * * * *